US010745174B2

(12) United States Patent
Johnson et al.

(10) Patent No.: US 10,745,174 B2
(45) Date of Patent: Aug. 18, 2020

(54) STACKABLE, COLLAPSIBLE PALLETS FOR TRANSPORTING WHEELED DEVICES AND RELATED SYSTEMS AND METHODS

(71) Applicant: Dane Technologies, Inc., Maple Grove, MN (US)

(72) Inventors: Dan Johnson, Medina, MN (US); James Huttner, Hopkins, MN (US)

(73) Assignee: Dane Technologies, Inc., Maple Grove, MN (US)

( * ) Notice: Subject to any disclaimer, the term of this patent is extended or adjusted under 35 U.S.C. 154(b) by 0 days.

(21) Appl. No.: 15/685,844

(22) Filed: Aug. 24, 2017

(65) Prior Publication Data

US 2018/0057204 A1 Mar. 1, 2018

Related U.S. Application Data

(60) Provisional application No. 62/379,028, filed on Aug. 24, 2016.

(51) Int. Cl.
*B65D 19/44* (2006.01)
*B65D 19/38* (2006.01)
(Continued)

(52) U.S. Cl.
CPC ..... *B65D 19/385* (2013.01); *B65D 19/06* (2013.01); *B65D 19/42* (2013.01); *B65D 2519/009* (2013.01); *B65D 2519/00064* (2013.01); *B65D 2519/0096* (2013.01); *B65D 2519/0097* (2013.01); *B65D 2519/00273* (2013.01); *B65D 2519/00293* (2013.01); *B65D 2519/00323* (2013.01); *B65D 2519/00333* (2013.01); *B65D 2519/00502* (2013.01); *B65D 2519/00532* (2013.01); *B65D 2519/00691* (2013.01); *B65D 2519/00781* (2013.01);
(Continued)

(58) Field of Classification Search
CPC ..... B65D 2519/00796; B65D 2519/00875; B65D 2519/00925; B65D 2519/0096; B65D 2519/0097; B65D 2519/00975
See application file for complete search history.

(56) References Cited

U.S. PATENT DOCUMENTS 4,186,841 A 2/1980 Buckley et al.
6,105,511 A * 8/2000 Bridges ..... H05K 7/1488 108/55.1
(Continued)

FOREIGN PATENT DOCUMENTS

DE 19934939 A1 3/2000
DE 20012639 U1 10/2000
(Continued)

OTHER PUBLICATIONS

SPS Ideal Solutions. Suspended Roll and Component Shipping Racks video form SPS Ideal Solutions. YouTube. Feb. 14, 2014. URL: https://youtu.be/RjuXIAD9o-l. entire video.
(Continued)

*Primary Examiner* — Matthew W Ing
(74) *Attorney, Agent, or Firm* — Davis, Brown, Koehn, Shors & Roberts, P.C.; Sean D. Solberg

(57) ABSTRACT

The various embodiments herein relate to collapsible and stackable pallets having a base, two fork channels, a transverse fork opening, and first and second extension frames.

20 Claims, 14 Drawing Sheets

(51) Int. Cl.
*B65D 19/06* (2006.01)
*B65D 19/42* (2006.01)

(52) U.S. Cl.
CPC ..... *B65D 2519/00796* (2013.01); *B65D 2519/00805* (2013.01); *B65D 2519/00875* (2013.01); *B65D 2519/00975* (2013.01)

(56) References Cited

U.S. PATENT DOCUMENTS

| | | | | |
|---|---|---|---|---|
| 2006/0103094 | A1 | 5/2006 | Wiff et al. | |
| 2012/0074138 | A1* | 3/2012 | Schutz | B65D 77/0466 220/88.1 |
| 2013/0233811 | A1 | 9/2013 | Glover et al. | |
| 2014/0299706 | A1 | 10/2014 | Disabantonio, III | |
| 2015/0257530 | A1* | 9/2015 | Naka | A47B 47/0091 211/188 |
| 2016/0325972 | A1* | 11/2016 | Taylor | B66F 9/065 |

FOREIGN PATENT DOCUMENTS

| | | | |
|---|---|---|---|
| DE | 19931248 | A1 | 1/2001 |
| DE | 20215597 | U1 | 4/2003 |
| DE | 202013006299 | U1 | 10/2014 |
| GB | 2416527 | A | 1/2006 |
| JP | 2007204126 | A | 8/2007 |
| WO | 2012012629 | A1 | 1/2012 |

OTHER PUBLICATIONS

Tier Rack. Folding Racks How To From Tier-Rack. YouTube. Aug. 24, 2014. URL: https://youtu.be/yR_Mw1oEkU0. entire video.

* cited by examiner

STACKABLE, COLLAPSIBLE PALLETS FOR TRANSPORTING WHEELED DEVICES AND RELATED SYSTEMS AND METHODS

CROSS-REFERENCE TO RELATED APPLICATION(S)

This application claims the benefit under 35 U.S.C. § 119(e) to U.S. Provisional Application 62/379,028, filed Aug. 24, 2016 and entitled "Stackable, Collapsible Pallets for Transporting Wheeled Devices and Related Systems and Methods," which is hereby incorporated herein by reference in its entirety.

FIELD OF THE INVENTION

Various embodiments disclosed herein relate to pallets having various unique features that make it possible for such pallets to transport wheeled objects, such as carts, for example, or other objects. Certain implementations relate to stackable, collapsible pallets.

BACKGROUND OF THE INVENTION

Carts and other wheeled objects have been used to move objects (such as products, etc.) from one place to another in retail, warehouse, and other environments in significant volume for years. In many situations, the movement of objects using carts requires multiple manual transfers of the objects, such as from the cart to another transport platform (such as, for example, a pallet) and then subsequently to another platform (such as another cart or a vehicle of some kind). For example, in certain retail or warehouse environments, a user (such as a shopper in the retail context) first obtains an empty cart (or other wheeled object) and then pushes the cart around the location while loading the desired items (such as products in the retail context) on the cart. Once the cart is full and/or the user has loaded all desired objects onto the cart, the user then pushes the cart to a desired location and loads the objects from the cart to a pallet. The pallet is then transported to a desired location by a forklift, pallet jack, or any other known device for moving a pallet. Once the pallet is moved to the desired location, the objects are moved from the pallet to another location, such as a vehicle. Alternatively, the objects can be moved from the pallet to another cart and then subsequently to another location, such as a vehicle. Regardless of the specific steps, the two or more manual transfers of the objects require someone to physically move the objects each time. This adds to the time and effort required for getting the objects from one place to another.

There is a need in the art for an improved pallet for transporting a cart from one place to another, and related systems and methods.

BRIEF SUMMARY OF THE INVENTION

Discussed herein are various pallets having various unique features, including collapsibility, stackability, and, in certain embodiments, the capacity to transport wheeled objects.

In Example 1, a pallet comprises a base, first and second fork sleeves extending along a length of the base, a transverse fork opening defined along a width of the base, and first and second extension frames pivotally coupled to the base, wherein each of the first and second extension frames move between a retracted position and an expanded position. Each of the first and second sleeves are sized and structured to receive a fork of a pallet-lifting apparatus. The transverse fork opening is sized and structured to receive two forks of the pallet-lifting apparatus.

Example 2 relates to the pallet according to Example 1, wherein the pallet is stackable with other pallets.

Example 3 relates to the pallet according to Example 1, further comprising front and rear base legs, wherein the first extension frame is pivotally coupled to the base via the front base legs and the second extension frame is pivotally coupled to the base via the rear base legs.

Example 4 relates to the pallet according to Example 1, further comprising first and second skids coupled to an underside of the base.

Example 5 relates to the pallet according to Example 1, further comprising first, second, third, and fourth base legs coupled to the base, wherein the first extension frame is pivotally coupled to the base via the first and second base legs, and wherein the second extension frame is pivotally coupled to the base via the third and fourth base legs.

Example 6 relates to the pallet according to Example 5, further comprising a space bounded by the first and second base legs at a front end of the base and by the third and fourth base legs at a rear end of the base, wherein the space is sized to receive a wheeled object on the base.

Example 7 relates to the pallet according to Example 1, further comprising a first pair of extension arms pivotally coupled to the first extension frame and a second pair of extension arms pivotally coupled to the second extension frame. Each of the first pair of extension arms comprises a first coupling component at a distal end thereof, and each of the first pair of extension arms is movable between a retracted position and an extended position. Each of the second pair of extension arms comprises a second coupling component at a distal end thereof, and each of the second pair of extension arms is movable between a retracted position and an extended position. The first coupling components are coupleable to the second coupling components when the first and second pairs of extension arms are in the extended positions.

In Example 8, a pallet comprises a base, first and second fork channels extending from a front end to a rear end of the base, a transverse fork opening extending from the first side to the second side of the base, first and second front base legs and first and second rear base legs coupled to the base, a first extension frame pivotally coupled to the first and second front base legs, and a second extension frame pivotally coupled to the first and second rear base legs. The first fork channel is disposed on a first side of the base and the second fork channel is disposed on a second side of the base. Each of the first and second fork channels are sized and structured to receive a fork of a pallet-lifting apparatus. The transverse fork opening is sized and structured to receive two forks of the pallet-lifting apparatus. The first extension frame is moveable between a retracted position and an expanded position. The second extension frame is moveable between a retracted position and an expanded position.

Example 9 relates to the pallet according to Example 8, wherein when the first and second extension frames are in the retracted positions, the pallet is stackable with other pallets.

Example 10 relates to the pallet according to Example 8, wherein when the first and second extension frames are in the expanded positions, the pallet is stackable with other pallets.

Example 11 relates to the pallet according to Example 8, wherein the first extension frame in the retracted position is substantially parallel to the base, and wherein the first extension frame in the expanded position is substantially transverse to the base.

Example 12 relates to the pallet according to Example 8, wherein the second extension frame in the retracted position is substantially parallel to the base, and wherein the second extension frame in the expanded position is substantially transverse to the base.

Example 13 relates to the pallet according to Example 8, further comprising a loading space defined between the first and second fork channels, wherein the loading space is constructed and arranged to receive a wheeled object when the first and second extension frames are in the expanded positions.

Example 14 relates to the pallet according to Example 8, further comprising first and second skids coupled to an underside of the base.

Example 15 relates to the pallet according to Example 8, further comprising a first extension arm pivotally coupled to the first extension frame, a second extension arm pivotally coupled to the first extension frame, a third extension arm pivotally coupled to the second extension frame, and a fourth extension arm pivotally coupled to the second extension frame. The first extension arm comprises a first coupling component at a distal end thereof, and the first extension arm is movable between a retracted position and an extended position. The second extension arm comprises a second coupling component at a distal end thereof, and the second extension arm is movable between a retracted position and an extended position. The third extension arm comprises a third coupling component at a distal end thereof, and the third extension arm is movable between a retracted position and an extended position. The fourth extension arm comprises a fourth coupling component at a distal end thereof, and the fourth extension arm is movable between a retracted position and an extended position. The first and third extension arms are coupleable at the first and third coupling components when the first and third extension arms are in the extended positions, and the second and fourth extension arms are coupleable at the second and fourth coupling components when second and fourth extension arms are in the extended positions.

Example 16 relates to the pallet according to Example 8, wherein the pallet has a minimal height profile when the first and second extension frames are in the retracted positions in comparison to the expanded positions.

Example 17 relates to the pallet according to Example 8, wherein the first and second fork channels are disposed above the transverse fork opening.

Example 18 relates to the pallet according to Example 8, wherein the first and second fork channels define a portion of an upper boundary of the transverse fork opening.

Example 19 relates to the pallet according to Example 8, further comprising a ramp disposed at the front end of the base.

Example 20 relates to the pallet according to Example 8, further comprising a set of deployable wheels rotatably coupled to the base.

In Example 21, a stackable pallet comprises a base, first and second fork channels extending from a front end to a rear end of the base, a transverse fork opening extending from the first side to the second side of the base, first and second front base legs and first and second rear base legs coupled to the base, a first extension frame pivotally coupled to the first and second front base legs, a second extension frame pivotally coupled to the first and second rear base legs, and a loading space defined between the first and second fork channels. The first fork channel is disposed on a first side of the base and the second fork channel is disposed on a second side of the base, and each of the first and second fork channels are sized and structured to receive a fork of a pallet-lifting apparatus. The transverse fork opening is sized and structured to receive two forks of the pallet-lifting apparatus. The first extension frame is moveable between a retracted position and an expanded position, and the second extension frame is moveable between a retracted position and an expanded position. The loading space is constructed and arranged to receive a wheeled object when the first and second extension frames are in the expanded positions.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Certain embodiments disclosed herein relate to stackable, collapsible pallets for use with various types of carts, trolleys, and other wheeled devices such that any such wheeled device can be positioned on one of the pallets. Other embodiments relate to pallets that can be stacked in both their collapsed and expanded configurations. According to one exemplary implementation, the pallet can be used with known flatbed carts such as those used in stores such as, for instance, IKEA®.

In accordance with some implementations, the various pallets disclosed or contemplated herein can be used as part of an efficient ordering process that eliminates multiple manual transfers of products or goods to a cart, from the cart to a pallet, and from the pallet to another cart. That is, in lieu of physically transferring any items onto and off of a cart, various pallet embodiments are provided that are configured to receive the cart itself, thereby eliminating the need to transfer the items. In one specific implementation that will be discussed in further detail below, any pallet disclosed or contemplated herein can be used in an online ordering system in which the items are purchased online and placed on a cart and then the cart is positioned on the pallet such that the pallet can be moved or transferred to another location without having to transfer the items from the cart.

The term "pallet" as used herein is intended to mean any flat transport structure that can be used in conjunction with a forklift or similar device or apparatus. Further, it is understood that any pallet embodiment disclosed or contemplated herein can be coupled with and transported by a forklift, pallet jack, front loader, work saver, any other jacking device, a crane, or any other known device or apparatus for coupling to and transporting flat transport structures from one place to another.

Figure 1A:
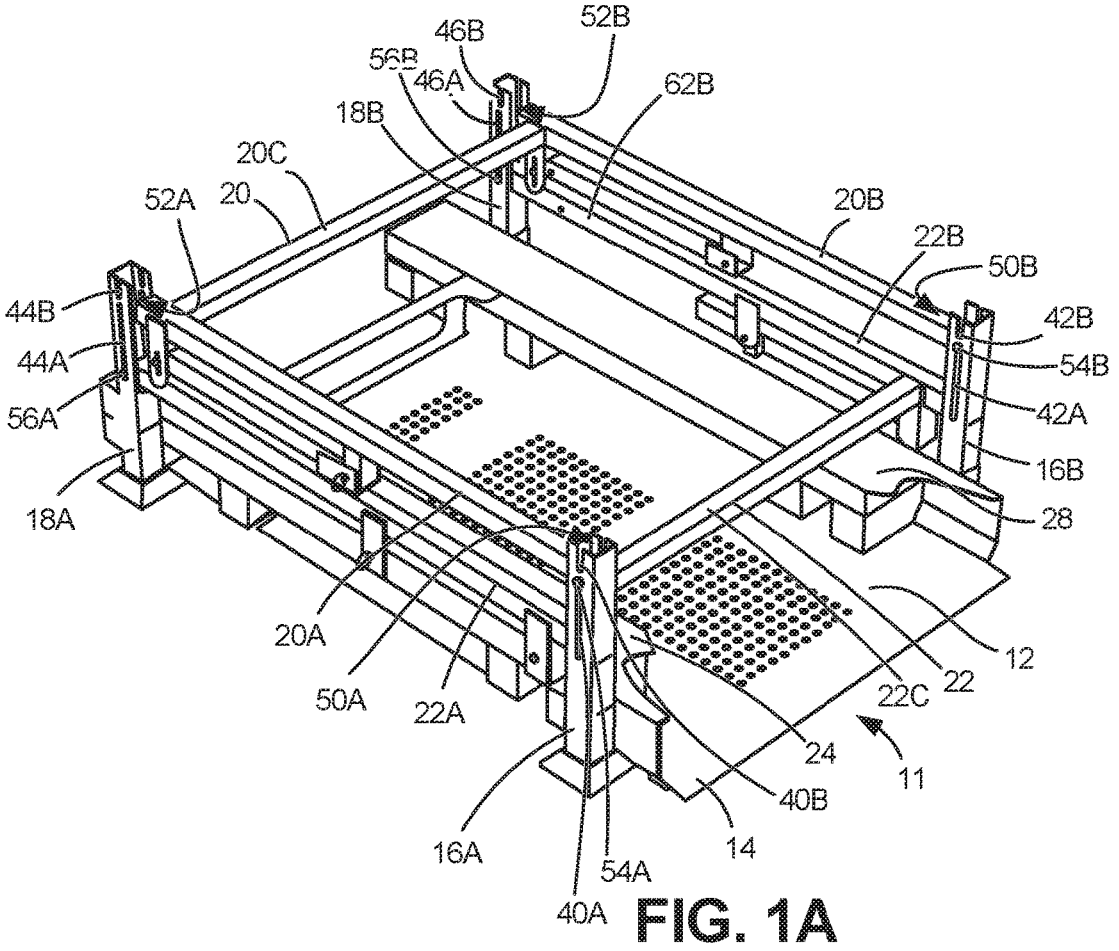
FIG. 1A is a front perspective view of a pallet, according to one embodiment.
Figure 1B:
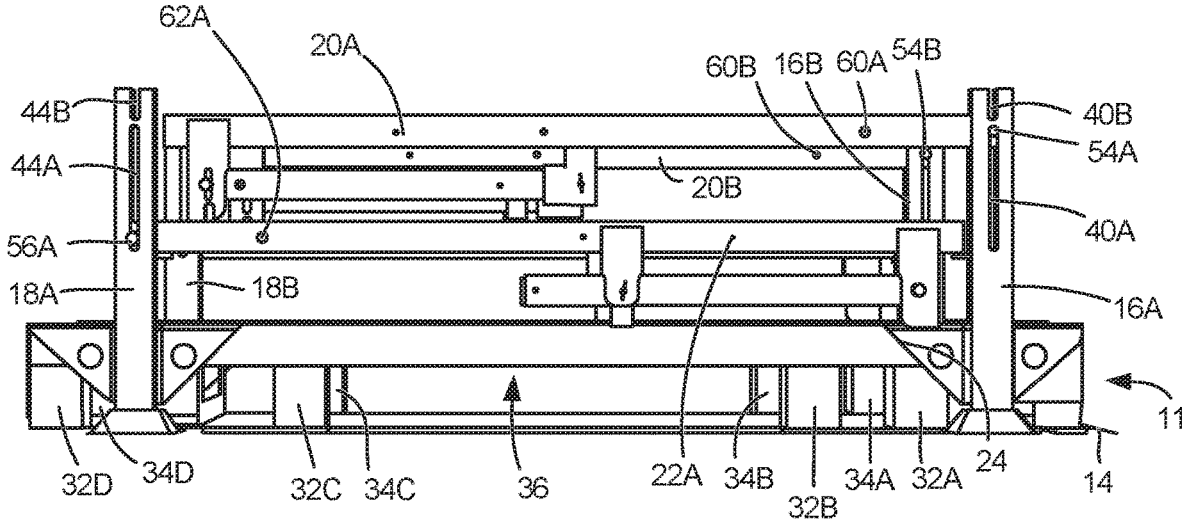
FIG. 1B is a side view of the pallet of FIG. 1A, according to one embodiment.
Figure 1C:
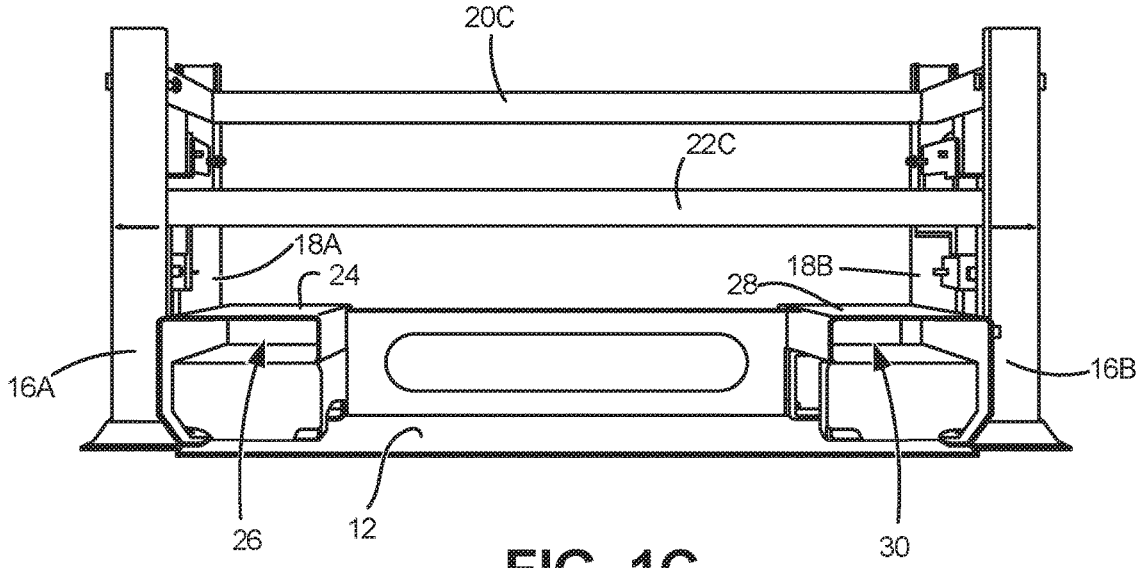
FIG. 1C is a front view of the pallet of FIG. 1A, according to one embodiment.
Figure 1D:
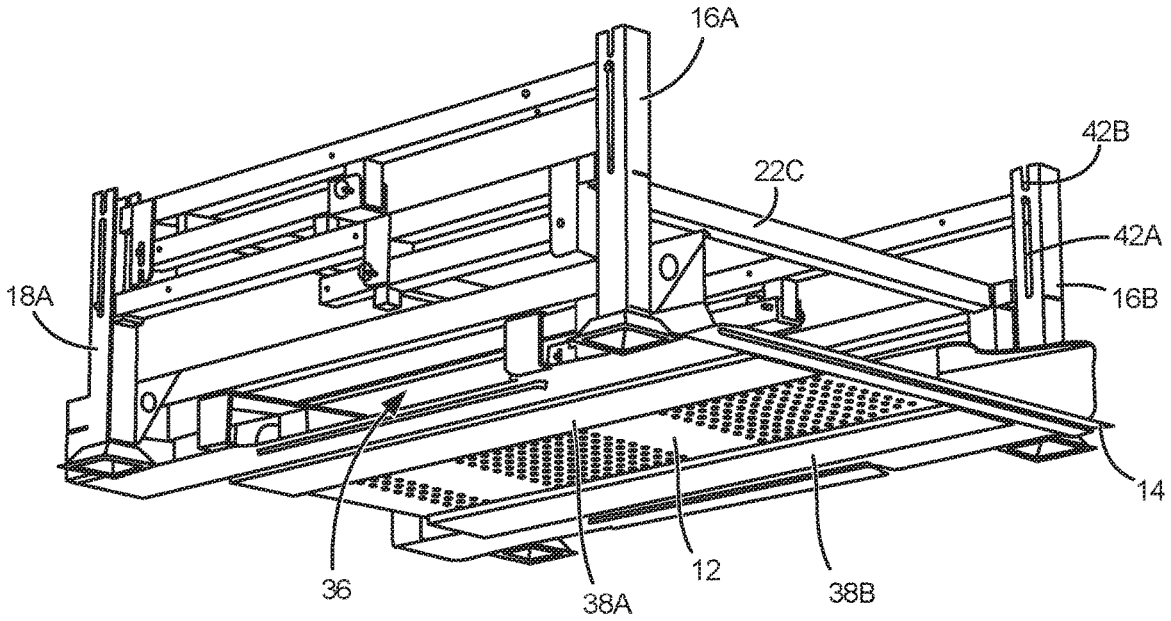
FIG. 1D is an underside perspective view of the pallet of FIG. 1A, according to one embodiment.
Figure 1E:
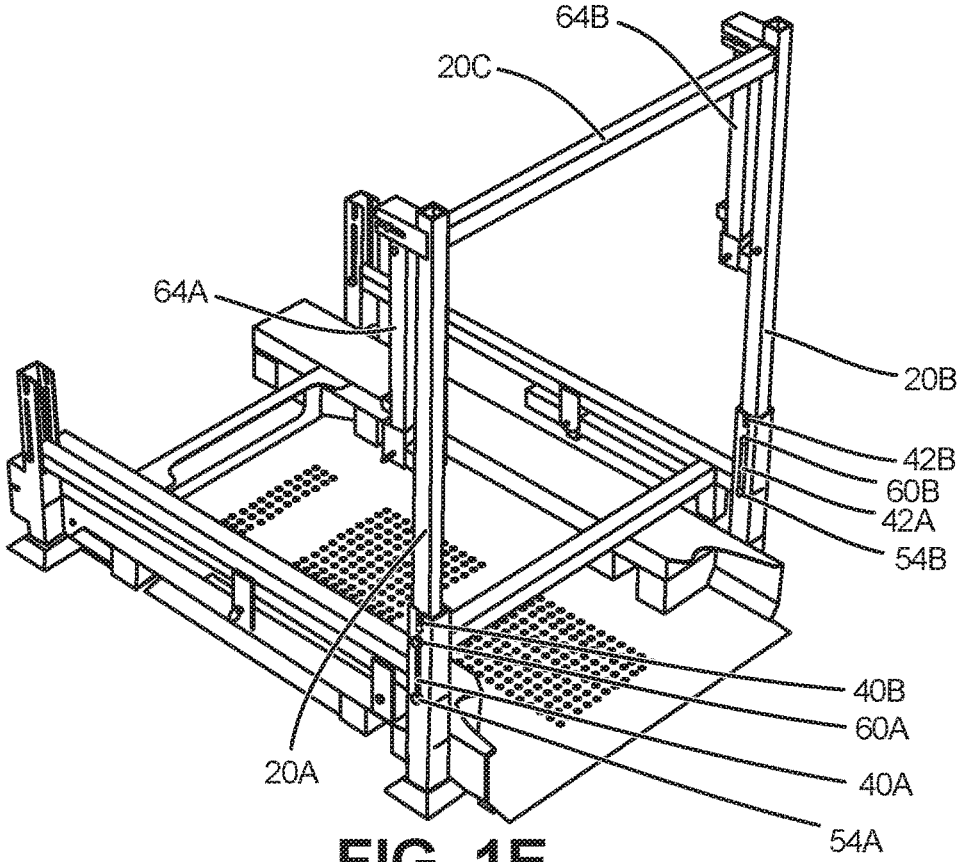
FIG. 1E is a front perspective view of the pallet of FIG. 1A with one of the extension frames in the expanded position, according to one embodiment.
Figure 1F:
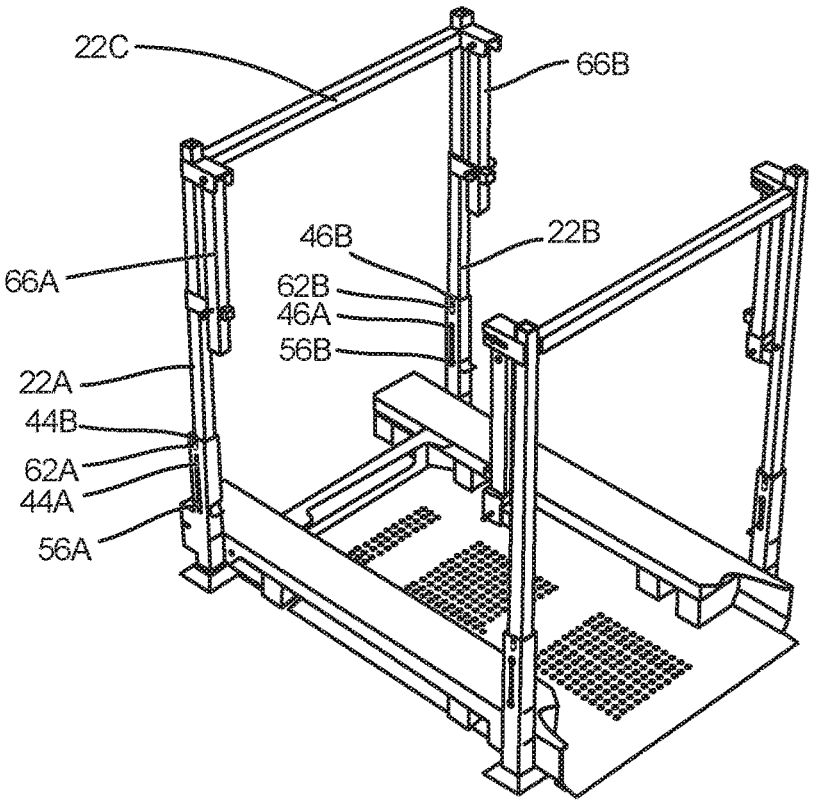
FIG. 1F is a front perspective view of the pallet of FIG. 1A with both of the extension frames in the expanded position, according to one embodiment.
Figure 1G:
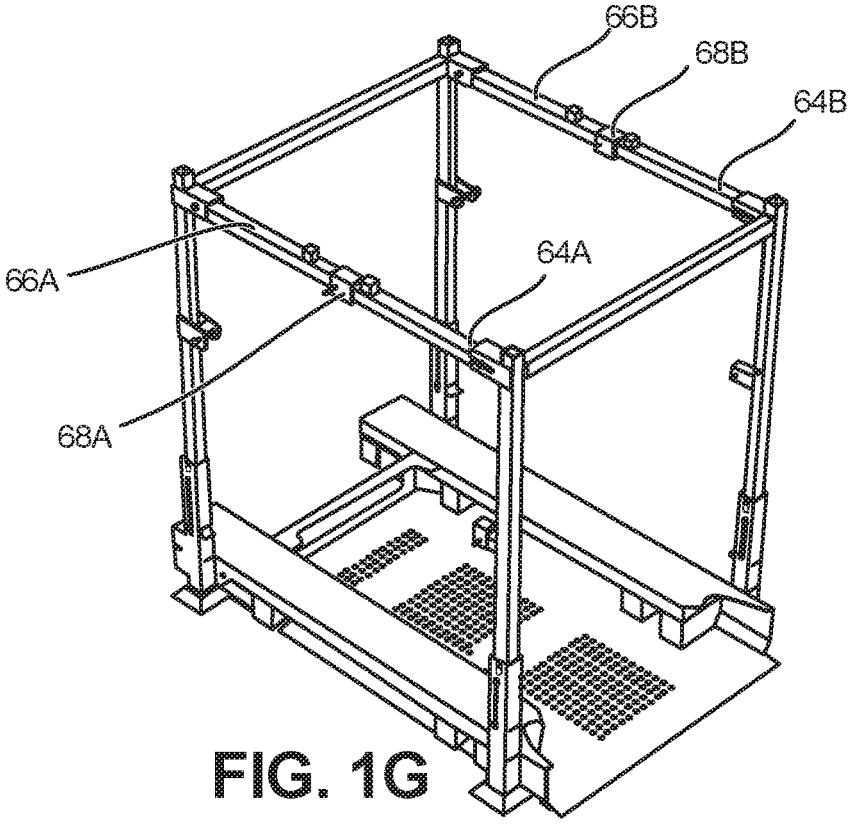
FIG. 1G is a front perspective view of the pallet of FIG. 1A with both of the extension frames in the expanded position and the extension arms in their extended positions, according to one embodiment.
Figure 1H:
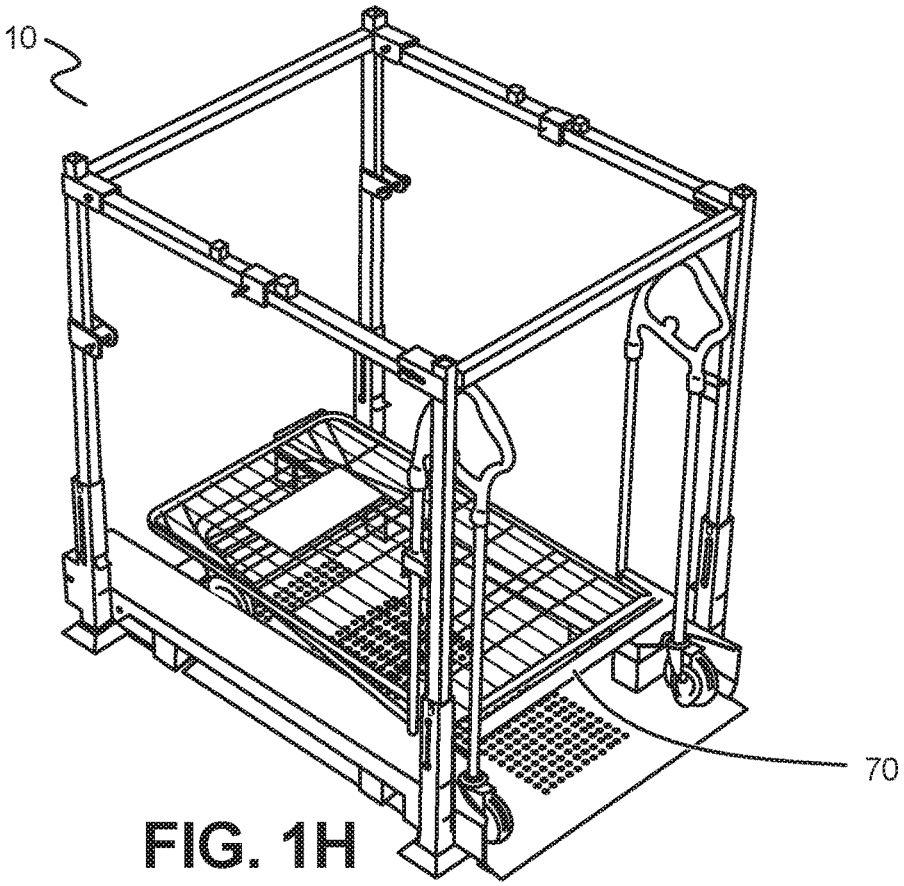
FIG. 1H is a front perspective view of the pallet of FIG. 1G with a wheeled cart disposed on the pallet, according to one embodiment.
Figure 1I:
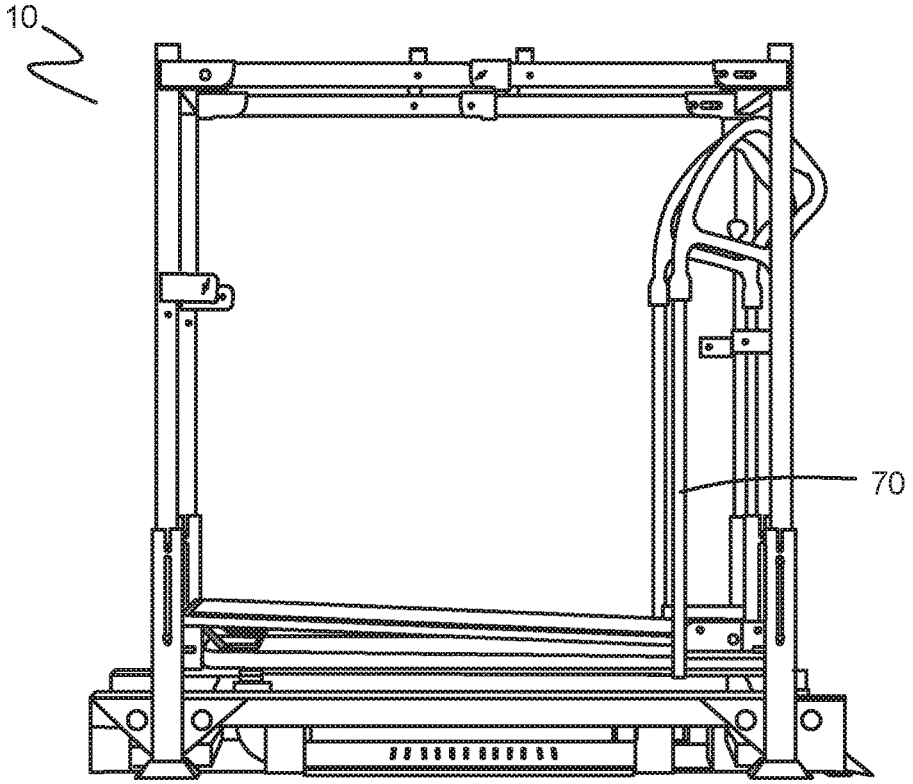
FIG. 1I is a side view of the pallet of FIG. 1H with the wheeled cart disposed on the pallet, according to one embodiment.

One example of a pallet 10 is depicted in FIGS. 1A-1I. As best shown in FIGS. 1A-1D, the pallet 10 in this exemplary implementation has a base 12, a base lip 14 on the front of the base 12, and four base legs 16A, 16B, 18A, 18B. As best shown in FIGS. 1A-1G, the pallet also has two extension frames 20, 22 that expand between retracted (or "collapsed" or "undeployed") positions, as shown in FIGS. 1A-1D, and expanded (or "unfolded" or "deployed") positions, as shown in FIGS. 1E-1G, as will be explained in further detail below.

As best shown in FIG. 10, the pallet 10 also has two longitudinal sleeves 24, 28 that define openings 26, 30 (respectively) configured to receive the forks of a forklift (not shown) or other similar device from the front 11 (as best shown in FIGS. 1A and 1B) of the pallet 10 and thereby be transported by the forklift in a fashion similar to a standard pallet. Each of the sleeves 24, 28 is positioned at a predetermined height above the base 12. More specifically, the sleeve 24 is positioned on or supported by four supports (also referred to as "feet") 32A, 32B, 32C, 32D (as best shown in FIG. 1B) that support the sleeve 24 and result in the sleeve 24 being positioned at a predetermined height above the base 12. Similarly, the sleeve 28 is positioned on or supported by four supports (also referred to as "feet") 34A, 34B, 34C, 34D (as best shown in FIG. 1B) that support the sleeve 28 and result in the sleeve 28 being positioned at a predetermined height above the base 12. This predetermined height of the two sleeves 24, 28 creates a transverse opening 36 as best shown in FIGS. 1B and 1D. The transverse opening 36 is configured to receive the forks of a forklift (not shown) or a pallet jack (not shown) from the side of the pallet 10. As such, a forklift (not shown) or pallet jack (not shown) can approach and couple to the pallet 10 from the front 11 or the side of the pallet 10.

It is understood that the term "sleeve" as used herein is intended to mean any tube, channel or elongate structure having an opening defined therethrough that is sized to receive a prong of a forklift, pallet jack, or other similar device as contemplated herein.

The pallet 10 also has two skids 38A, 38B (as best shown in FIG. 1D) attached to the underside of the base 12. In one implementation, the skids 38A, 38B are made of wood and are configured to be the main points of contact with the ground or floor on which the pallet 10 is positioned, thereby helping to eliminate any static electricity problems that could be created by an all-metal pallet.

Returning to FIGS. 1A, 1B, and 1D, each of the base legs 16A, 16B, 18A, 18B has two vertical slots defined therein: a first (or "lower") slot and a second (or "upper") slot. More specifically, as best shown in FIGS. 1A and 1B, the base leg 16A has a lower slot 40A and an upper slot 40B, the base leg 16B has a lower slot 42A and an upper slot 42B, the base leg 18A has a lower slot 44A and an upper slot 44B, and the base leg 18B has a lower slot 46A and an upper slot 46B. These vertical slots 40A-46B are configured to operate in conjunction with the extension frames 20, 22 to assist with the movement of the frames 20, 22 between the retracted and expanded positions, as will be described in further detail below. In one embodiment, each of the vertical slots in each of the base legs 16A, 16B, 18A, 18B extends through the width of each base leg 16A, 16B, 18A, 18B.

In accordance with one implementation, as best shown in FIG. 1A, each of the base legs 16A, 16B, 18A, 18B has an opening defined along one side of the leg 16A, 16B, 18A, 18B such that each base legs 16A, 16B, 18A, 18B is three-sided (with the fourth side being an opening). More specifically, base leg 16A has an opening 50A defined on the side of the leg 16A facing away from the front 11 of the pallet 10, base leg 16B has an opening 50B defined on the side of the leg 16B facing away from the front 11, base leg 18A has an opening 52A defined on the side of the leg 18A facing toward the front 11, and base leg 18B has an opening 52B defined on the side of the leg 18B facing toward the front 11. In this embodiment, each opening 50A, 50B, 52A, 52B extends from the distal end of each base leg 16A, 16B, 18A, 18B toward the proximal end of each leg 16A-18B at least to the bottom of the lower slot 40A, 42A, 44A, 46A of each leg 16A-18B along the length of each leg 16A-18B. In accordance with one implementation, each opening 50A, 50B, 52A, 52B is defined in each leg 16A-18B such that the sides of each leg 16A-18B having the vertical slots 40A-46B are adjacent to the side with the opening 50A, 50B, 52A, 52B.

Of course, it is understood that alternative embodiments of the base legs 16A, 16B, 18A, 18B can have other known features or components to operate in conjunction with extension frames such as frames 20, 22 disclosed here or other extension frames to assist with the movement of the frames (such as, but not limited to, the frames 20, 22) between the retracted and expanded positions.

In accordance with one implementation, as best shown in FIGS. 1A, 1E, and 1F, each of the two extension frames 20, 22 have two legs and a cross-bar. More specifically, the first (or "front") extension frame 20 has a first leg 20A, a second leg 20B, and a cross-bar 20C extending between and coupled to the distal ends of the two legs 20A, 20B, while the second (or "back") extension frame 22 has a first leg 22A, a second leg 22B, and a cross-bar 22C extending between and coupled to the distal ends of the two legs 22A, 22B. The proximal ends of the extension frame legs 20A, 20B, 22A, 22B are slidably coupled to the base legs 16A, 16B, 18A, 18B, respectively. More specifically, with respect to the first extension frame 20, the proximal end of the first leg 20A is disposed within the base leg 16A through the opening 50A and has a sliding bolt (or "lower bolt," "sliding peg," or "lower peg") 54A extending from both sides of the leg 20A such that the sliding bolt 54A is slidably disposed in the lower slot 40A, and the proximal end of the second leg 20B is disposed within the base leg 16B through the opening 50B and has a sliding bolt (or "lower bolt," "sliding peg," or "lower peg") 54B extending from both sides of the leg 20B such that the bolt 54B is slidably disposed in the lower slot 42A. Similarly, with respect to the second extension frame 22, the proximal end of the first leg 22A is disposed within the base leg 18A through the opening 52A and has a sliding bolt (or "lower bolt," "sliding peg," or "lower peg") 56A extending from both sides of the leg 22A such that the bolt 56A is slidably disposed in the lower slot 44A, and the proximal end of the second leg 22B is disposed within the base leg 18B through the opening 52B and has a sliding bolt (or "lower bolt," "sliding peg," or "lower peg") 56B extending from both sides of the leg 22B such that the bolt 56B is slidably disposed in the lower slot 46A.

In addition, as best shown in FIGS. 1A and 1B, each of the legs 20A, 20B, 22A, 22B have a locking bolt that help to couple the legs 20A, 20B, 22A, 22B to the base legs 16A, 16B, 18A, 18B and lock them therein. More specifically, in the first extension frame 20 (as best shown in FIG. 1B), the first leg 20A has a locking bolt 60A that is disposed on the leg 20A distally from the sliding bolt 54A and extends from both sides of the leg 20A, and the second leg 20B has a locking bolt 60B that is disposed on the leg 20B distally from the sliding bolt 54B and extends from both sides of the leg 20B. Similarly, in the second extension frame 22 (as best shown in FIGS. 1A and 1B), the first leg 22A has a locking bolt 62A that is disposed on the leg 22A distally from the sliding bolt 56A and extends from both sides of the leg 22A, and the second leg 22B has a locking bolt 62B that is disposed on the leg 22B distally from the sliding bolt 56B and extends from both sides of the leg 22B.

In use, the extension frames 20, 22 are moved from their retracted positions (as best shown in FIGS. 1A-1D) to their expanded positions (as best shown in FIGS. 1E-1I) in the following fashion. Because the first extension frame 20 is positioned on top of the second extension frame 22 in the retracted position (as best shown in FIGS. 1A and 1B), the first extension frame 20 is moved into its expanded position first (as best shown in FIG. 1E). More specifically, the first extension frame 20 is moved from its retracted position as best shown in FIG. 1B into its expanded position as shown in FIG. 1E by urging the cross-bar 20C upward away from the pallet base 12 such that the frame 20 begins to rotate at the sliding bolts 54A, 54B. As the cross-bar 20C rotates on the axis created by the sliding bolts 54A, 54B, the legs 20A, 20B move from a horizontal position (or a position in which the lengths of the legs 20A, 20B are parallel to length of the base 12) to a vertical position (or position in which the length of the legs 20A, 20B are perpendicular to the length of the base 12). As the legs 20A, 20B move into that vertical position, the sliding bolts 54A, 54B begin to move downward in the lower slots 40A, 42A toward the base 12 and thus the bottom of those slots 40A, 42A. When the legs 20A, 20B of the extension frame 20 reach the desired position in relation to the base legs 16A, 16B, the user can position the locking bolts 60A, 60B above the upper slots 40B, 42B of the base legs 16A, 16B and urge the legs 20A, 20B downward toward the base 12 such that the locking bolts 60A, 60B are slidably positioned into the upper slots 40B, 42B and urged downward until the bolts 60A, 60B rest at the bottom of the upper slots 40B, 42B, thereby locking the legs 20A, 20B in place and thus locking the first extension frame 20 in place in the expanded position as shown in FIG. 1E.

Once the first extension frame 20 is moved into its expanded position, the second extension frame 22 can then be moved into its expanded position as well. More specifically, the second extension frame 22 is moved from its retracted position as best shown in FIG. 1B into its expanded position as shown in FIG. 1F by urging the cross-bar 22C upward away from the pallet base 12 such that the frame 22 begins to rotate at the sliding bolts 56A, 56B. As the cross-bar 22C rotates on the axis created by the sliding bolts 56A, 56B, the legs 22A, 22B move from a horizontal position (or a position in which the lengths of the legs 22A, 22B are parallel to length of the base 12) to a vertical position (or position in which the length of the legs 22A, 22B are perpendicular to the length of the base 12). When the legs 22A, 22B of the extension frame 22 reach the desired position in relation to the base legs 18A, 18B, the user can position the locking bolts 62A, 62B above the upper slots 44B, 46B of the base legs 18A, 18B and urge the legs 22A, 22B downward toward the base 12 such that the locking bolts 62A, 62B are slidably positioned into the upper slots 44B, 46B and urged downward until the bolts 62A, 62B rest at the bottom of the upper slots 44B, 46B, thereby locking the legs 22A, 22B in place and thus locking the second extension frame 22 in place in the expanded position as shown in FIG. 1F.

In one alternative embodiment, as best shown in FIGS. 1E and 1F, the extension frames 20, 22 also have extension arms that can be moved into extended positions and coupled together when the frames 20, 22 are in their expanded positions such that the frames 20, 22 are coupled together. More specifically, as best shown in FIG. 1E, the frame 20 has a first extension arm 64A that is rotatably coupled at its proximal end to the distal end of the first leg 20A and positioned in its retracted position when positioned parallel to the first leg 20A as shown. Further, the frame 20 has a second extension arm 64B that is rotatably coupled at its proximal end to the distal end of the second leg 20B and positioned in its retracted position when positioned parallel to the second leg 20B as shown. In addition, as best shown in FIG. 1F, the frame 22 has a first extension arm 66A that is rotatably coupled at its proximal end to the distal end of the first leg 22A and positioned in its retracted position when positioned parallel to the first leg 22A as shown. Further, the frame 22 has a second extension arm 66B that is rotatably coupled at its proximal end to the distal end of the second leg 22B and positioned in its retracted position when positioned parallel to the second leg 22B as shown.

In use, as best shown in FIG. 1G, the extension arms 64A, 64B, 66A, 66B can be moved into their extended positions as shown and coupled to each other, thereby providing additional stability to the extension frames 20, 22. More specifically, both of the first arms 64A, 66A, are moved into their extended positions and coupled together at the first coupling component 68A. Similarly, both of the second arms 64B, 66B are moved into their extended positions and coupled together at the second coupling component 68B.

Once the extension frames 20, 22 have been moved into their expanded positions and—in those embodiments having them—the extension arms 64A, 64B, 66A, 66B are coupled together in their extended positions, the pallet 10 can be used to transport carts as necessary. More specifically, once the frames 20, 22 and arms 64A, 64B, 66A, 66B are deployed properly, a cart (such as, for example, the cart 70 depicted in FIGS. 1H and 1I) can be positioned on the pallet 10. Once the cart (such as cart 70) is positioned on the pallet 10, the pallet 10 can be transported to any desired location.

Figure 2A:
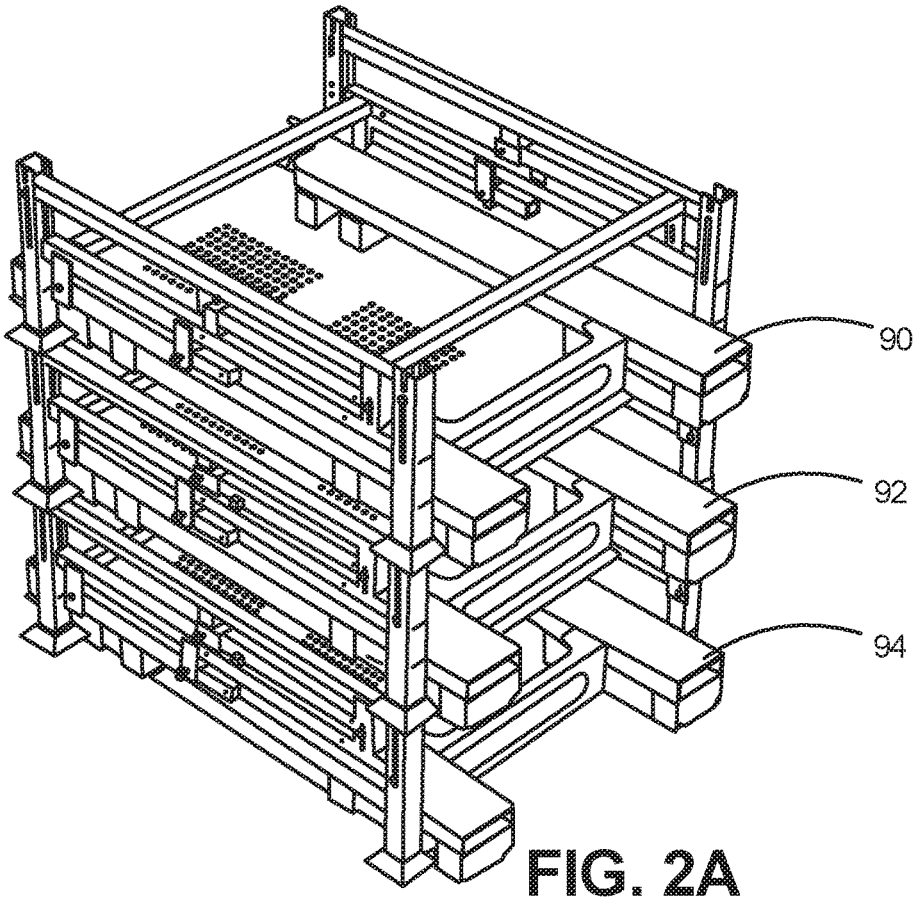
FIG. 2A is a front perspective view of three pallets stacked together, according to one embodiment.
Figure 2B:
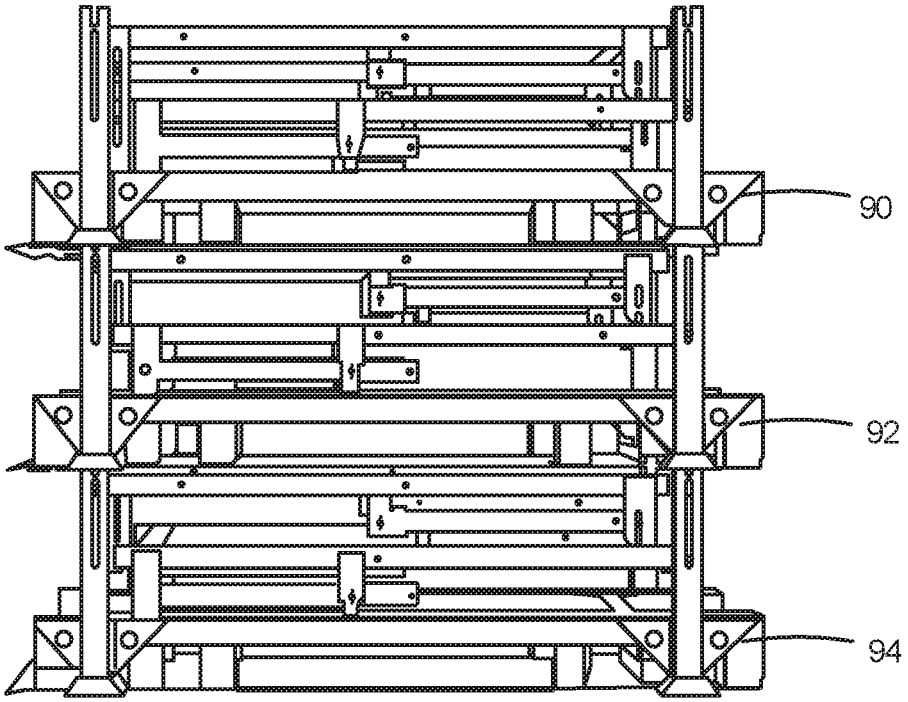
FIG. 2B is a side view of the three pallets of FIG. 2A, according to one embodiment.
Figure 2C:
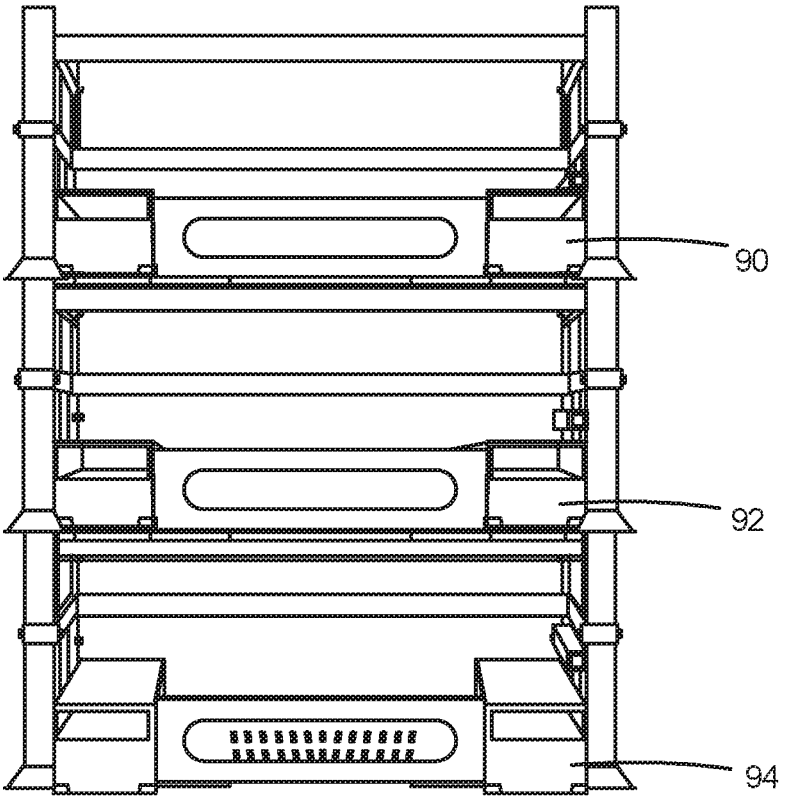
FIG. 2C is a front view of the three pallets of FIG. 2A, according to one embodiment.

According to certain alternative implementations, the various pallet embodiments disclosed herein can be easily stackable and transportable between uses. For example, as best shown in FIGS. 2A-2C, the three pallets 90, 92, 94 are configured to be stackable in their retracted configurations as shown. In one embodiment, the three pallets 90, 92, 94 are substantially similar to the pallet 10 discussed above. Alternatively, the three pallets 90, 92, 94 have different configurations and/or features in comparison with the pallet 10.

Figure 3A:
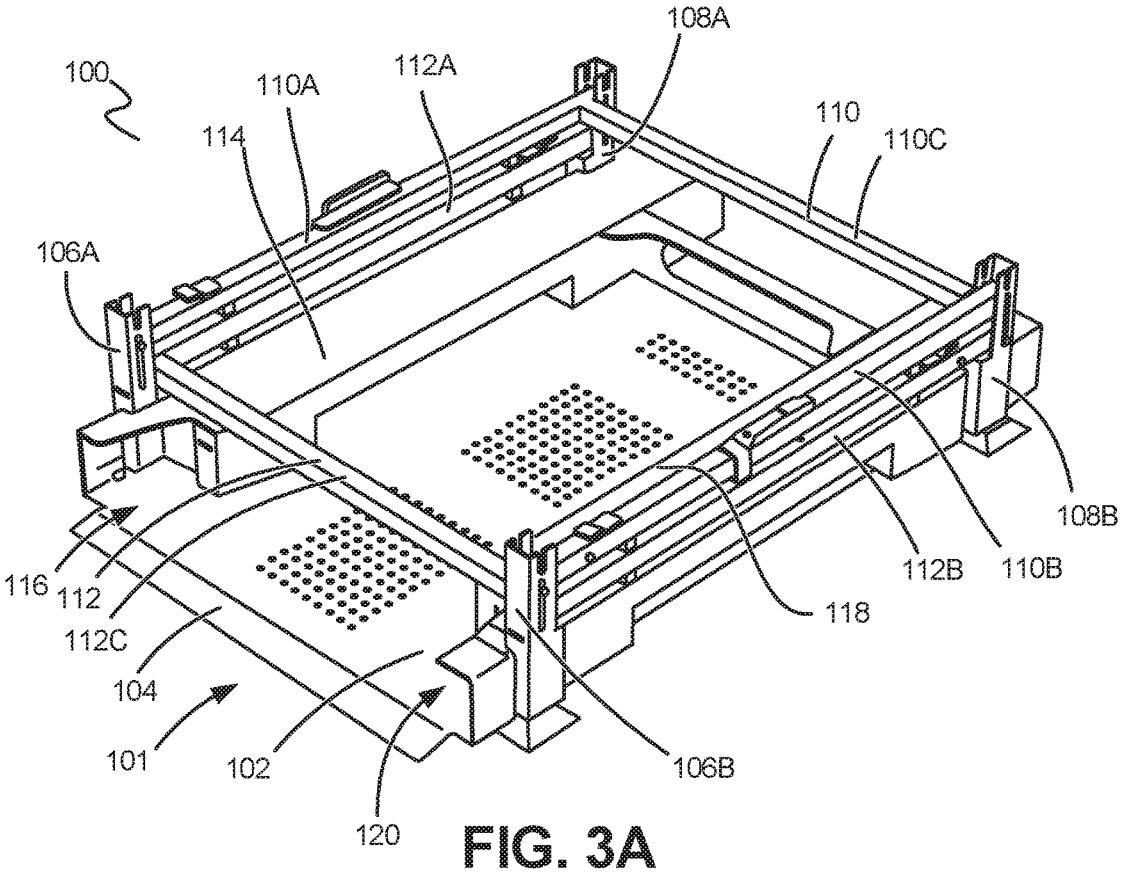
FIG. 3A is a front perspective view of a pallet, according to another embodiment.
Figure 3B:
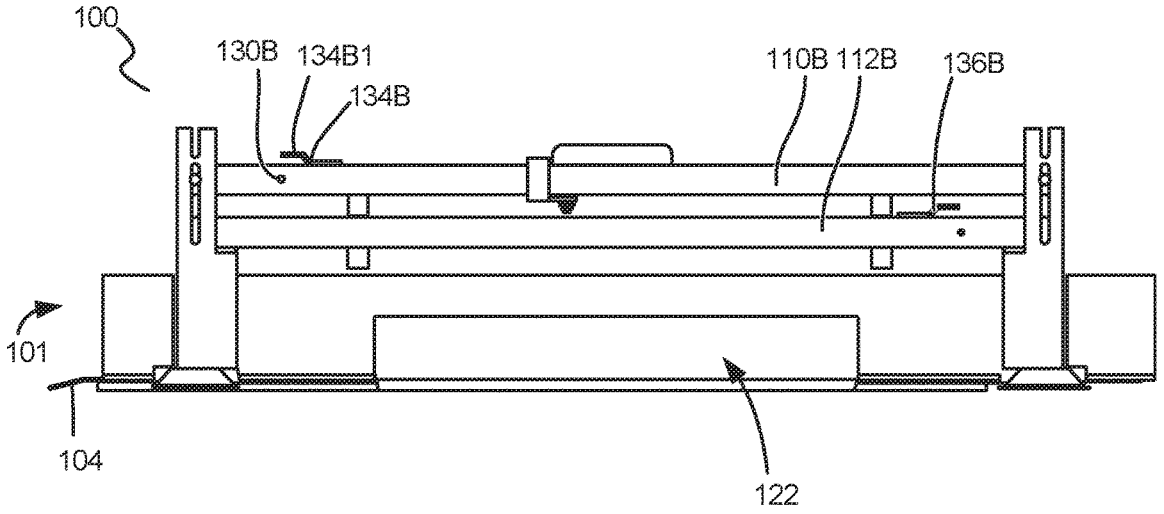
FIG. 3B is a side view of the pallet of FIG. 3A, according to one embodiment.
Figure 3C:
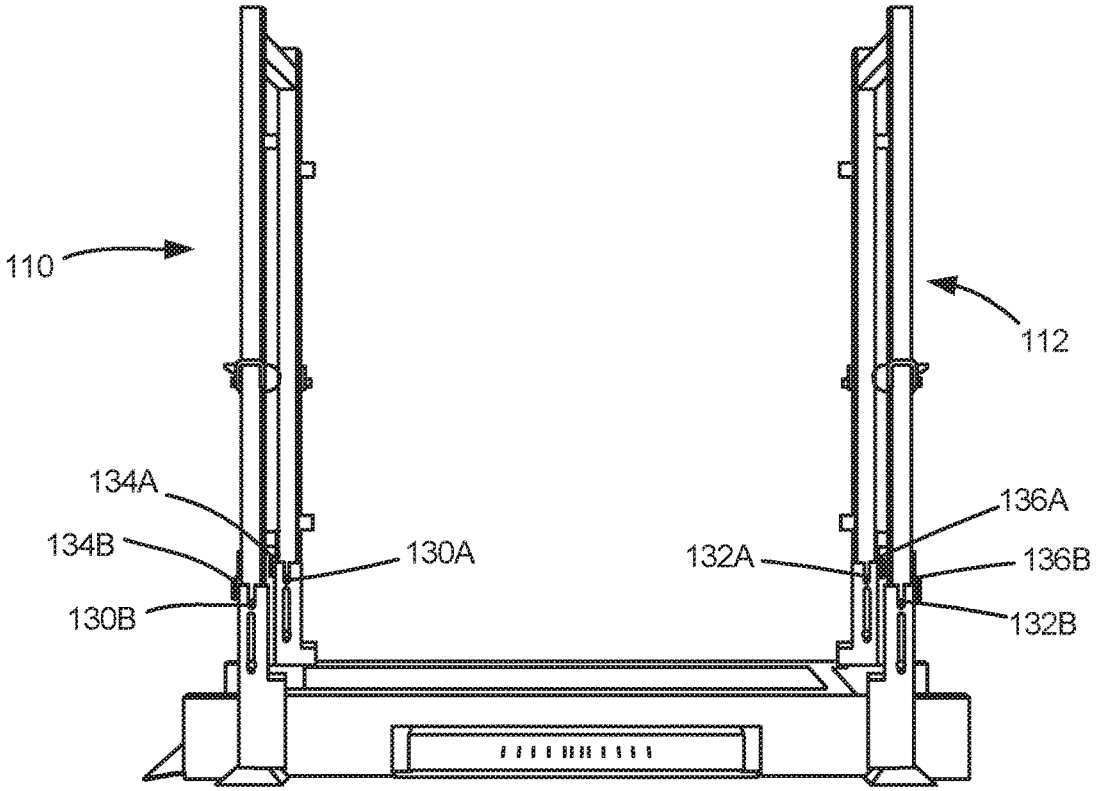
FIG. 3C is a side view of the pallet of FIG. 3A with both of the extension frames in the expanded position, according to one embodiment.
Figure 3D:
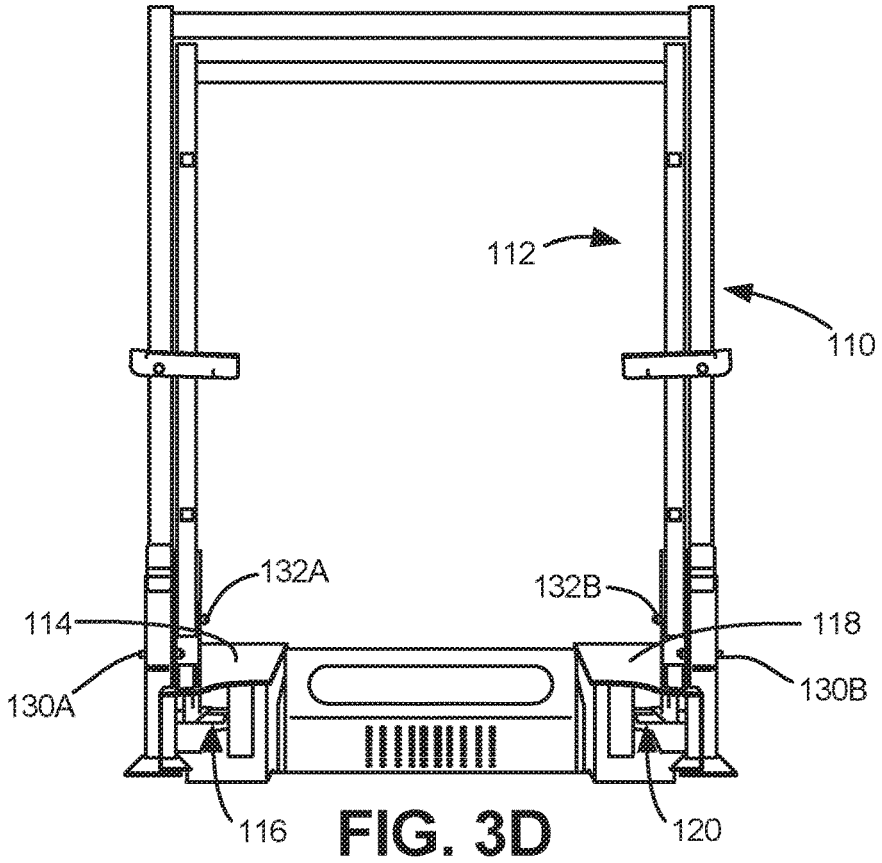
FIG. 3D is a front view of the pallet of FIG. 3A with both of the extension frames in the expanded position, according to one embodiment.
Figure 3E:
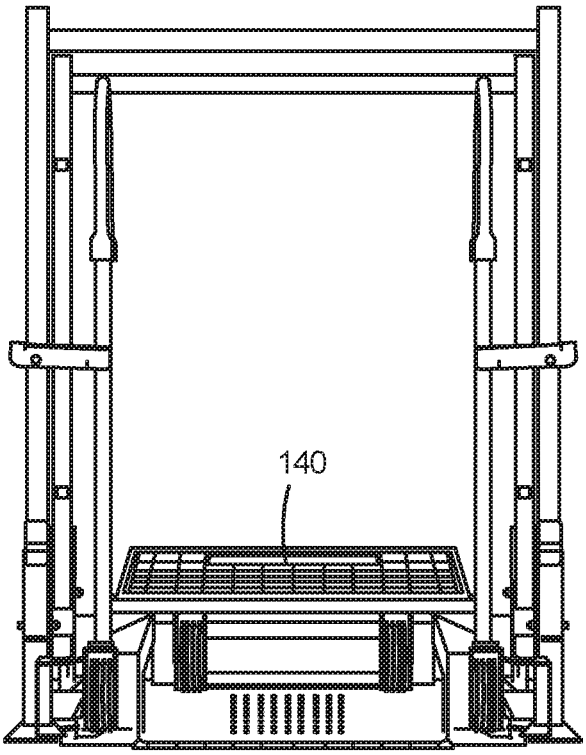
FIG. 3E is a front view of the pallet of FIG. 3D with a wheeled cart disposed on the pallet, according to one embodiment.

An alternative embodiment of a pallet 100 is depicted in FIGS. 3A-3H. It is understood that the pallet 100 can have the same or similar features as those of the pallet 10 except as discussed herein. As best shown in FIGS. 3A and 3B, the pallet 100 in this exemplary implementation has a base 102, a base lip 104 on the front of the base 102, and four base legs 106A, 106B, 108A, 108B. The pallet 100 also has two extension frames 110, 112 that expand between retracted (or "collapsed" or "undeployed") positions, as shown in FIGS. 3A and 3B, and expanded (or "unfolded" or "deployed") positions, as shown in FIGS. 3C-3H. As best shown in FIGS. 3A and 3D, the pallet 100 also has two longitudinal sleeves 114, 118 that define openings 116, 120 (respectively) configured to receive the forks of a forklift (not shown) from the front 101 of the pallet 100 and thereby be transported by the forklift in a fashion similar to a standard pallet. Unlike the previous pallet 10, each of the sleeves 114, 118 is positioned on the base 102 rather than being positioned some distance above the base 102. Further, the pallet 100 has a transverse opening 122 defined in the sleeves 114, 118 as best shown in FIG. 3B. As with the previous pallet 10, the transverse opening 122 is configured to receive the forks of a forklift (not shown) or a pallet jack (not shown) from the side of the pallet 100.

Figure 3F:
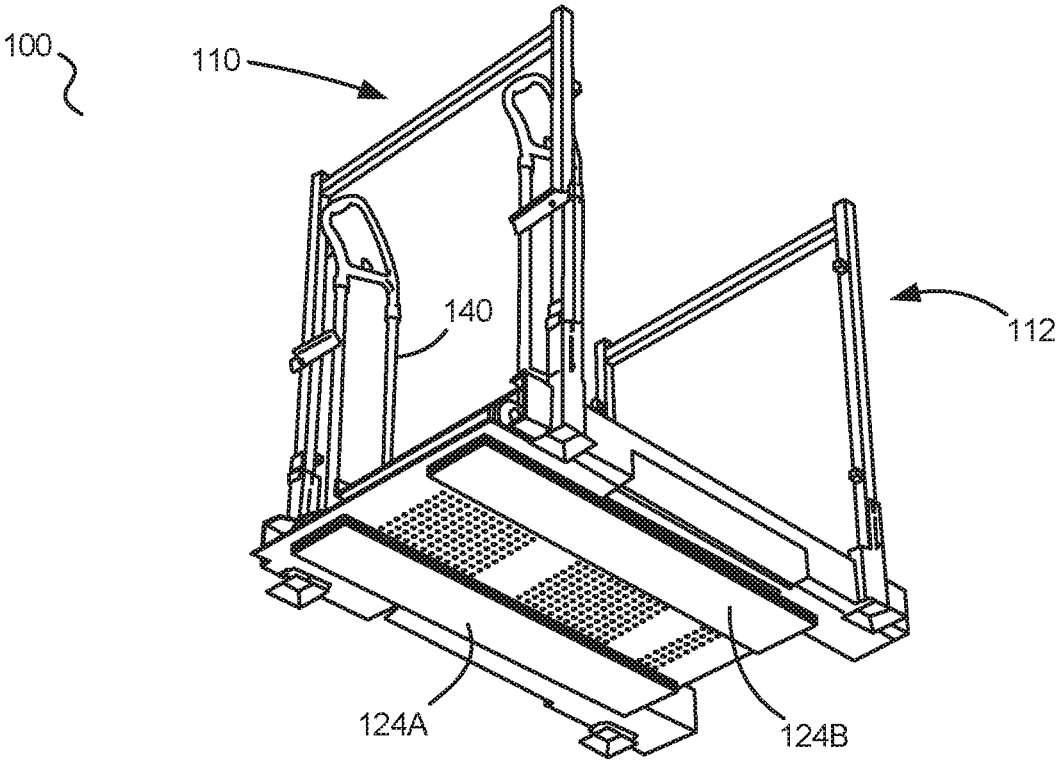
FIG. 3F is an underside perspective view of the pallet of FIG. 3E with a wheeled cart disposed on the pallet, according to one embodiment.
Figure 3G:
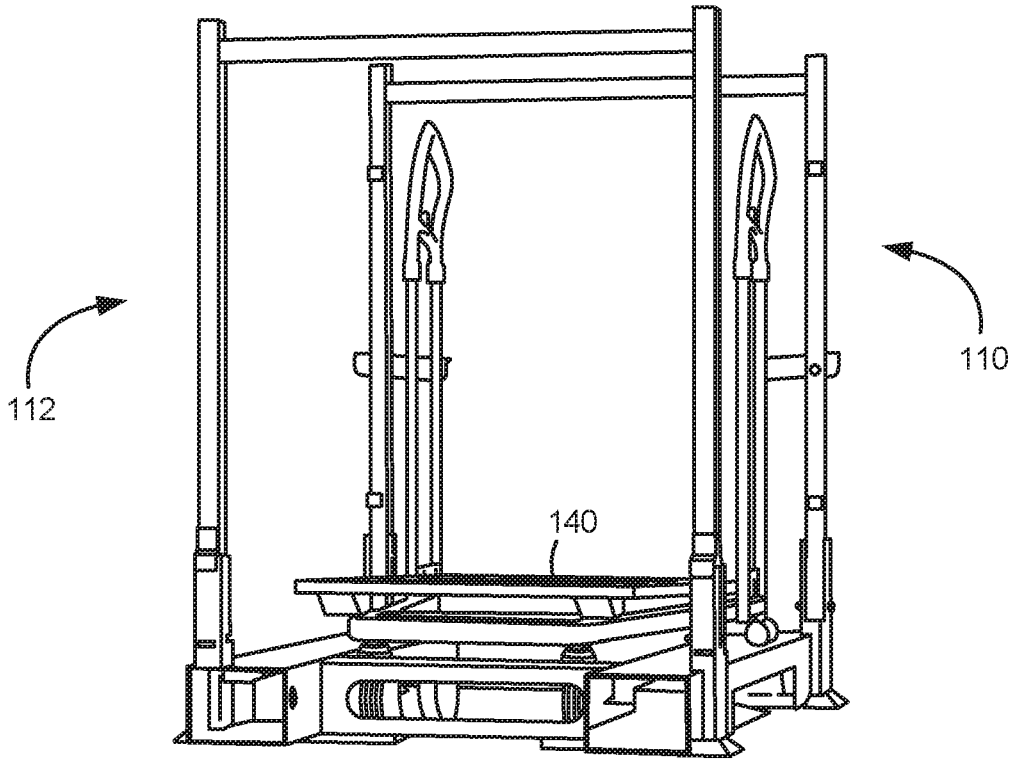
FIG. 3G is a rear perspective view of the pallet of FIG. 3E with a wheeled cart disposed on the pallet, according to one embodiment.
Figure 3H:
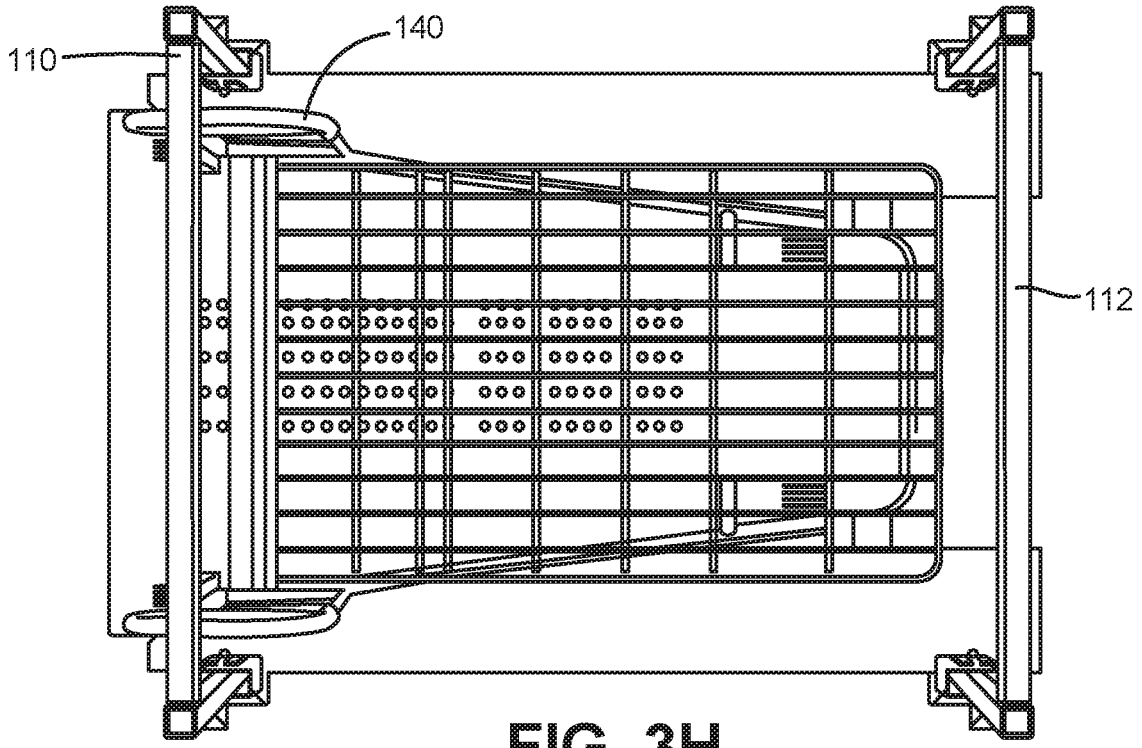
FIG. 3H is a top view of the pallet of FIG. 3E with a wheeled cart disposed on the pallet, according to one embodiment.

The pallet 100 also has two skids 124A, 124B (as best shown in FIG. 3F) attached to the underside of the base 102. In one implementation, the skids 124A, 124B are made of wood and are configured to be the main points of contact with the ground or floor on which the pallet 100 is positioned, thereby helping to eliminate any static electricity problems that could be created by an all-metal pallet.

It is understood that the two extension frames 110, 112 in this implementation operate in substantially the same fashion as the frames 20, 22 discussed above. More specifically, each of the base legs 106A, 106B, 108A, 108B of this pallet 100 has upper and lower slots—substantially similar to the upper and lower slots discussed with respect to the base legs 16A, 16B, 18A, 18B above—and further has openings—substantially similar to the openings 50A, 50B, 52A, 52B above—that are configured to receive the legs of the extension frames 110, 112. In one embodiment, the openings and the legs of the extension frames 110, 112 operate together in substantially the same fashion as described above with respect to the pallet 10. Alternatively, the base legs 106A, 106B, 108A, 108B can have different known features or components for operating in cooperation with extension frames such as, for example, the extension frames 110, 112 discussed herein or other extension frame embodiments to allow the extension frames to operate in a fashion similar to those disclosed or contemplated herein.

Like the pallet 10, in this pallet 100 embodiment, each of the two extension frames 110, 112 have two legs and a cross-bar having a substantially similar configuration as the frames 20, 22 discussed above. More specifically, the first (or "front") extension frame 110 has a first leg 110A, a second leg 110B, and a cross-bar 110C, while the second (or "back") extension frame 112 has a first leg 112A, a second leg 112B, and a cross-bar 112C. The proximal ends of the extension frame legs 110A, 110B, 112A, 112B are slidably coupled to the base legs 106A, 106B, 108A, 108B, respectively, in substantially the same fashion as described above with respect to pallet 10.

Further, like the pallet 10 above, in this implementation, each of the legs 110A, 110B, 112A, 112B have a locking bolt that help to couple the legs 110A, 110B, 112A, 112B to the base legs 106A, 106B, 108A, 108B and lock them therein. More specifically, in the first extension frame 110 as best shown in FIGS. 3C and 3D, the first leg 110A has a locking bolt 130A that is disposed on the leg 110A distally from the proximal end of the leg 110A and extends from both sides of the leg 110A, and the second leg 110B has a locking bolt 130B that is disposed on the leg 110B distally from the proximal end of the leg 110B and extends from both sides of the leg 110B. Similarly, in the second extension frame 112 as best shown in FIGS. 3C and 3D, the first leg 112A has a locking bolt 132A that is disposed on the leg 112A distally from the proximal end of the leg 112A and extends from both sides of the leg 112A, and the second leg 112B has a locking bolt 132B that is disposed on the leg 112B distally from the proximal end of the leg 112B and extends from both sides of the leg 112B.

In addition, this pallet 110 embodiment has an additional locking or retention mechanism on each of the frame legs 110A, 110B, 112A, 112B that helps to couple the legs 110A, 110B, 112A, 112B to the base legs 106A, 106B, 108A, 108B and lock or retain them therein. As best shown in FIG. 3B, in one example, this additional mechanism is a locking tab (such as, for example, the locking tab 134B) which is attached to the leg 110B and has a tab extension 134B1 that is spaced from the leg 110B such that the tab extension 134B1 can be positioned outside the base leg 106B when the frame leg 110B is positioned in the base leg 106B, thereby locking the frame leg 110B in place. As best shown in FIG. 3C, in the first extension frame 110, the first leg 110A has a locking tab 134A that is disposed on the leg 110A distally from the proximal end of the leg 110A as shown, and the second leg 110B has a locking tab 134B that is disposed on the leg 110B distally from the proximal end of the leg 110B as shown. Similarly, in the second extension frame 112, the first leg 112A has a locking tab 136A that is disposed on the leg 112A distally from the proximal end of the leg 112A, and the second leg 112B has a locking tab 136B that is disposed on the leg 112B distally from the proximal end of the leg 112B. Alternatively, any pallet embodiment disclosed or contemplated herein can have locking tabs similar to the tabs 134A, 134B, 136A, 136B.

In use, the extension frames 110, 112 operate in substantially the same fashion as the frames 20, 22 discussed above. That is, the frames 110, 112 can be moved from their retracted positions (as best shown in FIGS. 3A-3B) to their expanded positions (as best shown in FIGS. 3C-3H) in a substantially similar fashion as the frames 20, 22. In this embodiment, the locking tabs 134A, 134B, 136A, 136B provide an additional locking mechanism to assist with locking the frame legs 110A, 110B, 112A, 112B to the base legs 106A, 106B, 108A, 108B.

In this implementation, the frames 110, 112 do not have any extension arms coupling the two frames 110, 112 together as disclosed in the pallet 10 embodiment above. Alternatively, the frames 110, 112 can have extension arms (not shown).

Once the frames 110, 112 are deployed, the pallet 100 can be used to transport carts as necessary. More specifically, once the frames 110, 112 are deployed properly, a cart (such as, for example, the cart 140 depicted in FIGS. 3E-3H) can be positioned on the pallet 100. Once the cart (such as cart 140) is positioned on the pallet 100, the pallet 100 can be transported to any desired location.

Figure 4:
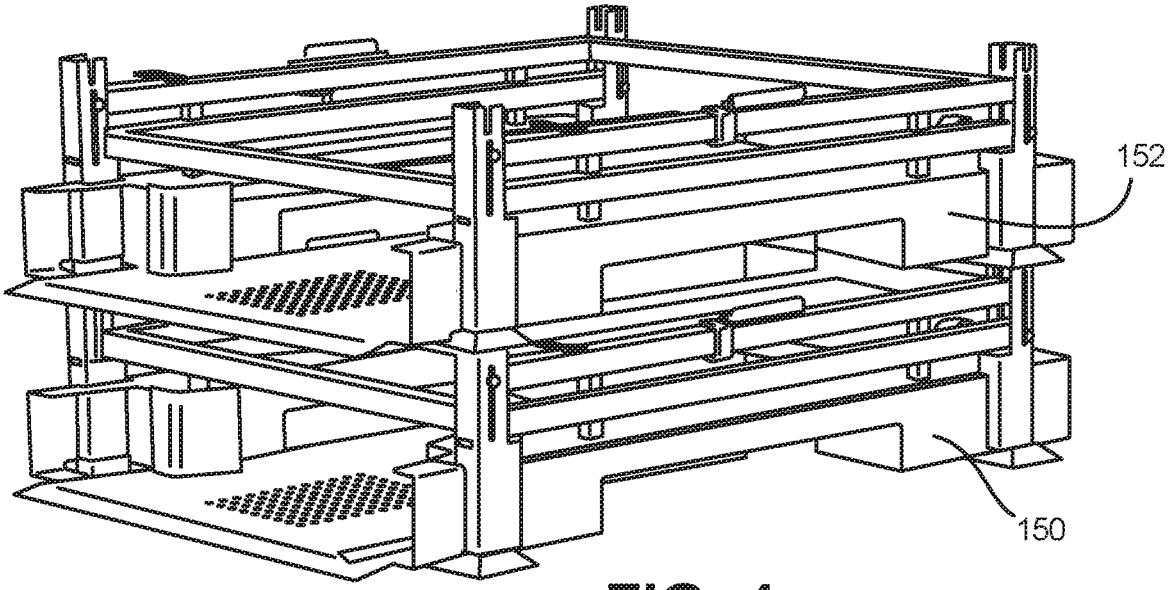
FIG. 4 is a front perspective view of two pallets stacked together with extension frames in the undeployed position, according to one embodiment.
Figure 5:
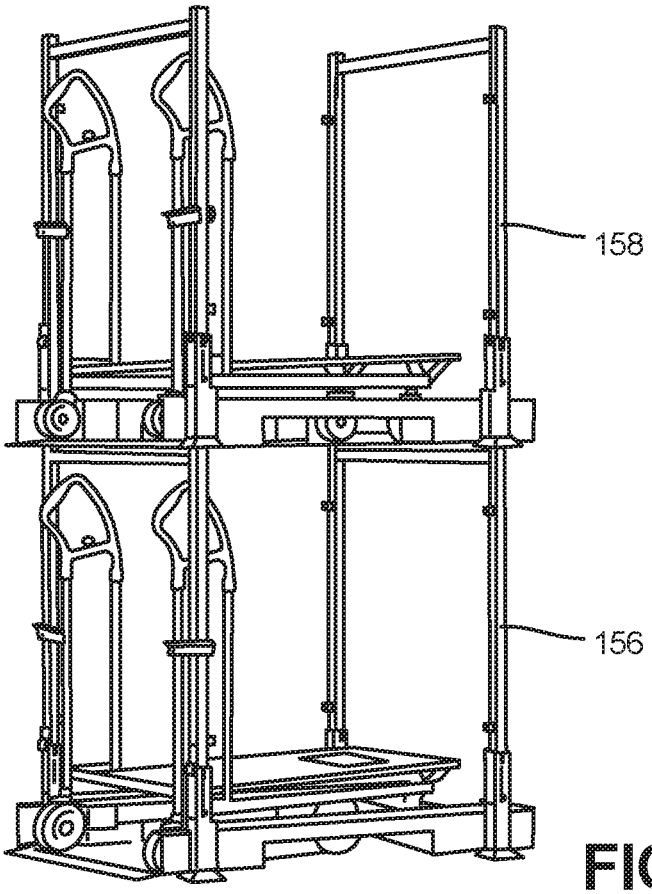
FIG. 5 is a front perspective view of two pallets stacked together with extension frames in the deployed position, according to one embodiment.

As mentioned above, according to certain alternative implementations, the various pallet embodiments disclosed or contemplated herein can be easily stackable and transportable between uses. That is, pallet 10, pallet 100, or any other pallet embodiment disclosed or contemplated herein can be stackable and transportable with other such pallets as described herein. For example, as best shown in FIG. 4, two pallets 150, 152 are configured to be stackable in their retracted configurations as shown. In one embodiment, the two pallets 150, 152 are substantially similar to the pallet 100 discussed above. Alternatively, the two pallets 150, 152 can be substantially similar to the pallet 10 or can have different features or components. In a further implementation, the various pallet embodiments can also be stackable in their expanded configurations, as best shown in FIG. 5. More specifically, FIG. 5 depicts two pallets 156, 158 that are configured to be stackable in their expanded configurations. The pallets 156, 158 can be substantially similar to the pallet 10 or the pallet 100 discussed above or can have different features or components. It is understood that any pallet embodiment disclosed or contemplated herein can be stackable while in the expanded configuration.

Figure 6:
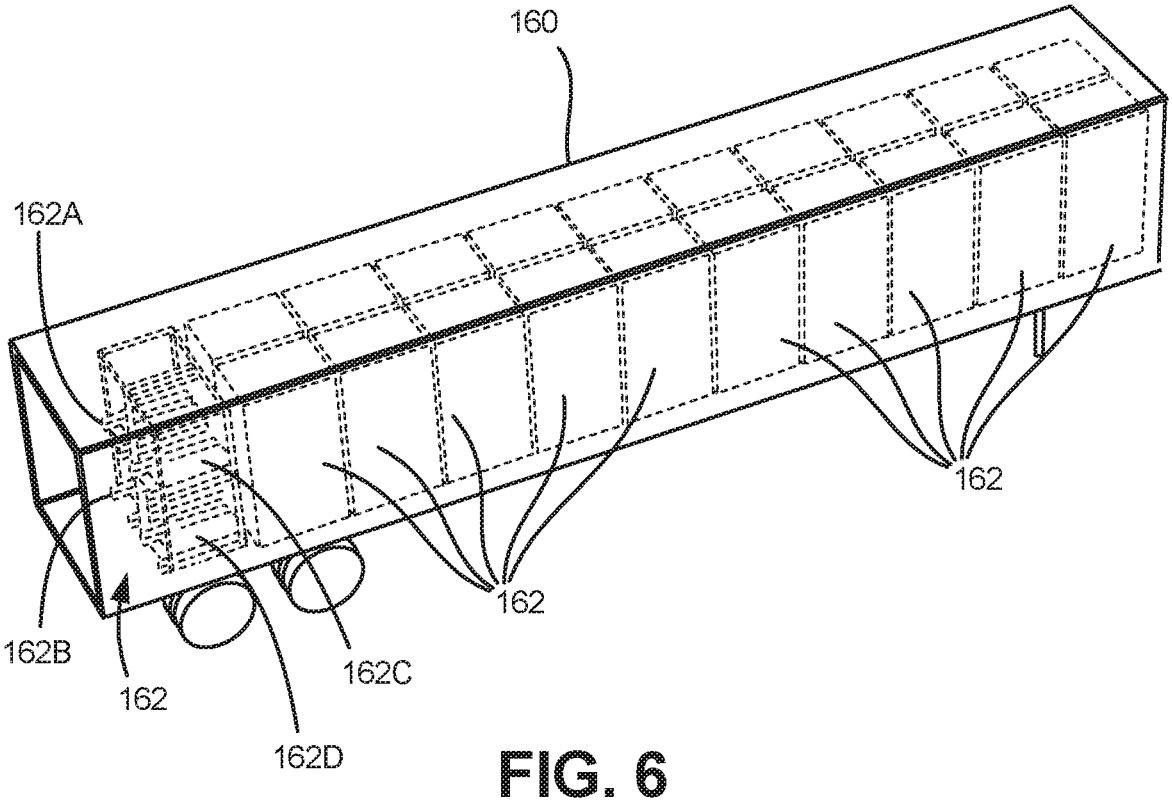
FIG. 6 is a rear perspective cutaway view of tractor trailer containing stacked pallets, according to one embodiment.

In certain embodiments, the various pallet embodiments disclosed herein are sized and can be stackable in a fashion that allows for optimal loading of a semi truck trailer. For example, as shown in FIG. 6, the pallets can be stacked and loaded onto the trailer 160 such that the space available in the trailer 160 is utilized optimally. More specifically, each row 162 of stacked pallets can contain four pallets 162A, 162B, 162C, 162D such that—in the specific depicted embodiment—there are 11 rows of pallets totaling 44 stacked pallets. Alternatively, the pallets can be stacked in a different arrangement from that depicted in FIG. 6.

An alternative embodiment of a pallet 180 is depicted in FIGS. 7A-7D. It is understood that the pallet 180 can have the same or similar features and components as those of pallets 10, 100 except as discussed herein. The pallet 180 in this exemplary implementation has a set of deployable wheels 182A, 182B, 184A, 184B that can allow for a user to move the pallet 180 around on the wheels.

Figure 7A:
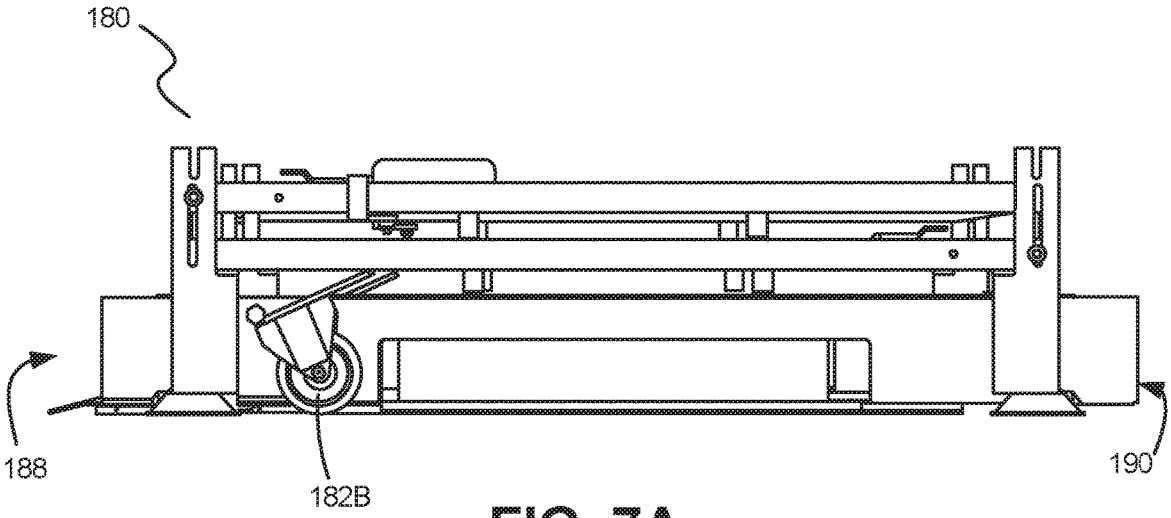
FIG. 7A is a side view of a pallet, according to a further embodiment.
Figure 7B:
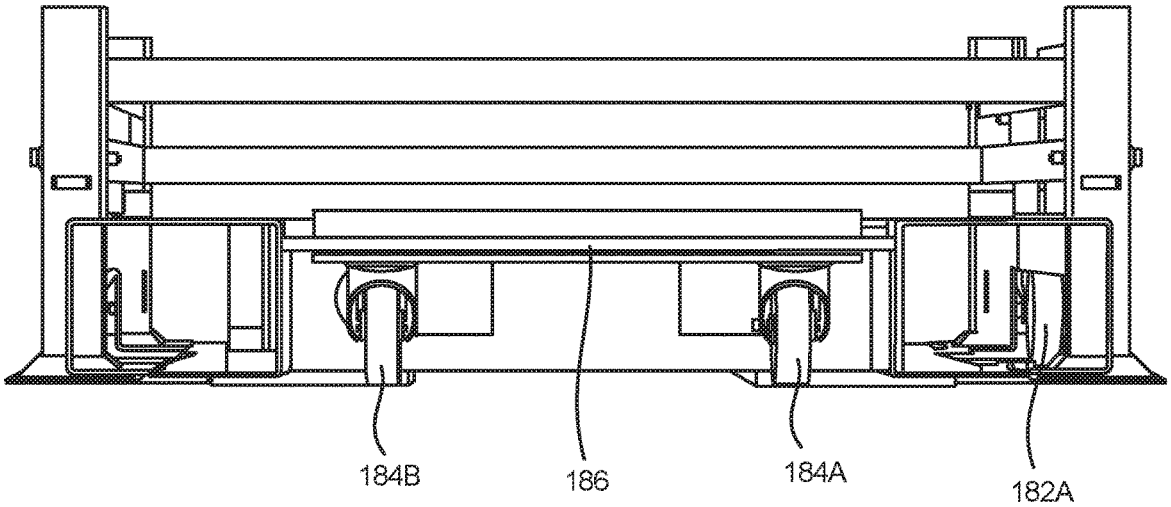
FIG. 7B is a rear view of the pallet of FIG. 7A, according to one embodiment.
Figure 7C:
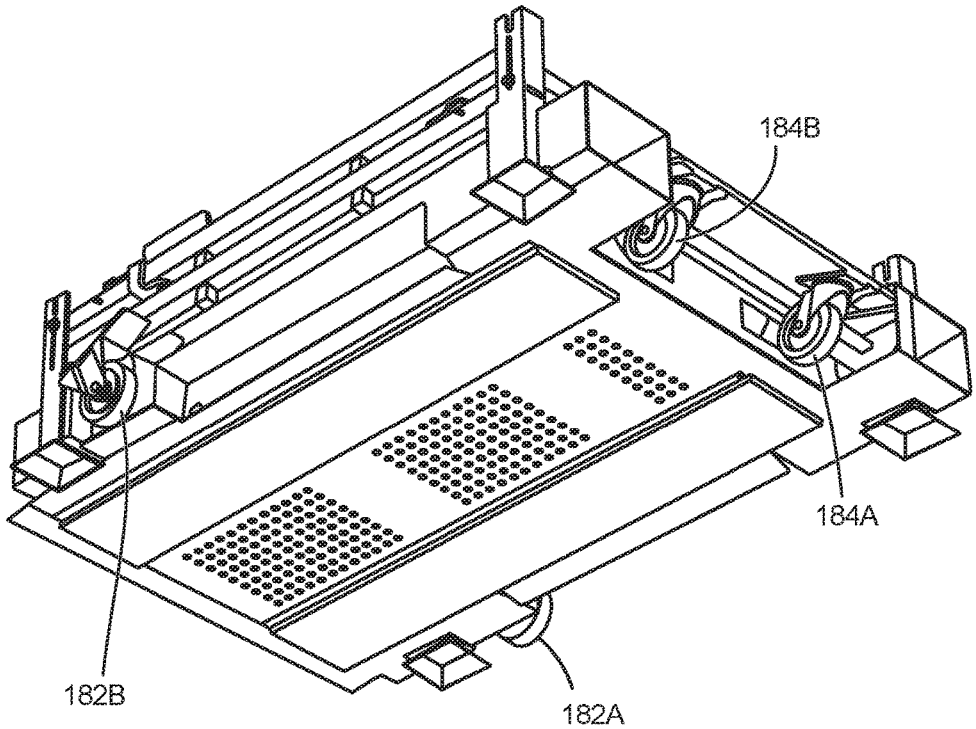
FIG. 7C is an underside perspective view of the pallet of FIG. 7A, according to one embodiment.
Figure 7D:
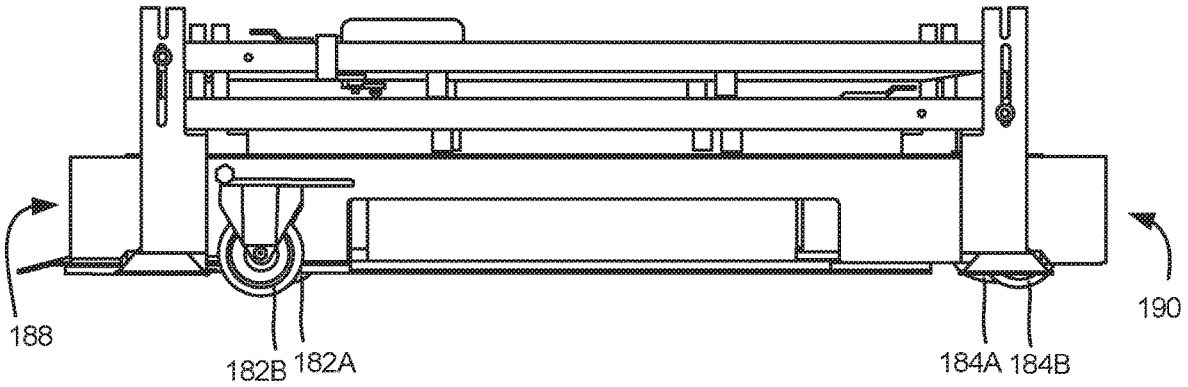
FIG. 7D is another side view of the pallet of FIG. 7A, according to one embodiment.

More specifically, the pallet 180 has two deployable fixed wheels 182A, 182B disposed near the front end 188 of the pallet as shown. Alternatively, the wheels 182A, 182B can be swivel wheels. The wheels 182A, 182B can be locked in the retracted position as shown in FIGS. 7A-7C and is movable into the deployed position as shown in FIG. 7D and can be locked in the deployed position as well. In one embodiment, the wheels 182A, 182B can be locked in the retracted or deployed position via a known pin mechanism (not shown). Further, the wheels 182A, 182B can be moved between the retracted and deployed positions using a known lever mechanism (not shown). Alternatively, any known mechanism(s) for allowing the wheels 182A, 182B to move between the two positions and be locked in both can be used.

Further, the pallet 180 has two deployable swivel wheels 184A, 184B disposed at or near the rear end 190 of the pallet 180 as shown. Alternatively, the wheels 184A, 184B can be fixed wheels. The wheels 184A, 184B has a lever mechanism 186 that can be moved between a retracted position as shown in FIG. 7B to a deployed position (not shown), thereby causing the wheels 184A, 184B to move between a retracted position as shown in FIG. 7B to a deployed position as shown in FIG. 7D. Alternatively, any known mechanism(s) for allowing the wheels 182A, 182B to move between the two positions can be used. Further, like the wheels 182A, 182B discussed above, the wheels 184A, 184B can be locked in the retracted or deployed position via a known pin mechanism (not shown) or any other known mechanism for locking wheels in place in a similar fashion.

In use, the wheels 182A, 182B, 184A, 184B can be deployed to raise the pallet 180 off of the ground or floor such that a user can move the pallet 180 to another location without having to lift the pallet 180 manually or with a forklift or other such apparatus. In one embodiment, the wheels 182A, 182B, 184A, 184B raise the pallet 180 such that there is about 1 inch of clearance between the bottom of the pallet 180 and the ground/floor. Alternatively, the clearance can be any desired clearance.

Although the present invention has been described with reference to preferred embodiments, persons skilled in the art will recognize that changes may be made in form and detail without departing from the spirit and scope of the invention.

What is claimed is:

1. A pallet comprising:

(a) a base;

(b) first and second fork sleeves extending along a length of the base, wherein each of the first and second sleeves are sized and structured to receive a fork of a pallet-lifting apparatus;

(c) a transverse fork opening defined along a width of the base, wherein the transverse fork opening is sized and structured to receive two forks of the pallet-lifting apparatus; and (d) first and second extension frames pivotally coupled to the base, wherein each of the first and second extension frames move between a retracted position and an expanded position.

2. The pallet of claim 1, wherein the pallet is stackable with other pallets.

3. The pallet of claim 1, further comprising front and rear base legs, wherein the first extension frame is pivotally coupled to the base via the front base legs and the second extension frame is pivotally coupled to the base via the rear base legs.

4. The pallet of claim 1, further comprising first and second skids coupled to an underside of the base.

5. The pallet of claim 1, further comprising first, second, third, and fourth base legs coupled to the base, wherein the first extension frame is pivotally coupled to the base via the first and second base legs, and wherein the second extension frame is pivotally coupled to the base via the third and fourth base legs.

6. The pallet of claim 5, further comprising a space bounded by the first and second base legs at a front end of the base, and by the third and fourth base legs at a rear end of the base, wherein the space is sized to receive a wheeled object on the base.

7. The pallet of claim 1, further comprising:

(a) a first pair of extension arms pivotally coupled to the first extension frame, wherein each of the first pair of extension arms comprises a first coupling component at a distal end thereof, and wherein each of the first pair of extension arms is movable between a retracted position and an extended position; and (b) a second pair of extension arms pivotally coupled to the second extension frame, wherein each of the second pair of extension arms comprises a second coupling component at a distal end thereof, and wherein each of the second pair of extension arms is movable between a retracted position and an extended position, wherein the first coupling components are coupleable to the second coupling components when the first and second pairs of extension arms are in the extended positions.

8. A pallet comprising:

(a) a base;

(b) first and second fork channels extending from a front end to a rear end of the base, wherein the first fork channel is disposed on a first side of the base and the second fork channel is disposed on a second side of the base, wherein each of the first and second fork channels are sized and structured to receive a fork of a pallet-lifting apparatus;

(c) a transverse fork opening extending from the first side to the second side of the base, wherein the transverse fork opening is sized and structured to receive two forks of the pallet-lifting apparatus;

(d) first and second front base legs and first and second rear base legs coupled to the base;

(e) a first extension frame pivotally coupled to the first and second front base legs, wherein the first extension frame is moveable between a retracted position and an expanded position; and (f) a second extension frame pivotally coupled to the first and second rear base legs, wherein the second extension frame is moveable between a retracted position and an expanded position; and (g) a loading space defined above the base and sized to receive a wheeled object, wherein the loading space is accessible for the wheeled object when the first and second extension frames are in the expanded positions and is inaccessible for the wheeled object when the first and second extension frames are in the retracted positions.

9. The pallet of claim 8, wherein when the first and second extension frames are in the retracted positions, the pallet is stackable with other pallets.

10. The pallet of claim 8, wherein when the first and second extension frames are in the expanded positions, the pallet is stackable with other pallets.

11. The pallet of claim 8, wherein the first extension frame in the retracted position is substantially parallel to the base, and wherein the first extension frame in the expanded position is substantially transverse to the base.

12. The pallet of claim 8, wherein the second extension frame in the retracted position is substantially parallel to the base, and wherein the second extension frame in the expanded position is substantially transverse to the base.

13. The pallet of claim 8, further comprising first and second skids coupled to an underside of the base.

14. The pallet of claim 8, further comprising:

(a) a first extension arm pivotally coupled to the first extension frame, wherein the first extension arm comprises a first coupling component at a distal end thereof, and wherein the first extension arm is movable between a retracted position and an extended position;

(b) a second extension arm pivotally coupled to the first extension frame, wherein the second extension arm comprises a second coupling component at a distal end thereof, and wherein the second extension arm is movable between a retracted position and an extended position;

(c) a third extension arm pivotally coupled to the second extension frame, wherein the third extension arm comprises a third coupling component at a distal end thereof, and wherein the third extension arm is movable between a retracted position and an extended position; and (d) a fourth extension arm pivotally coupled to the second extension frame, wherein the fourth extension arm comprises a fourth coupling component at a distal end thereof, and wherein the fourth extension arm is movable between a retracted position and an extended position, wherein the first and third extension arms are coupleable at the first and third coupling components when the first and third extension arms are in the extended positions, and wherein the second and fourth extension arms are coupleable at the second and fourth coupling components when second and fourth extension arms are in the extended positions.

15. The pallet of claim 8, wherein the pallet has a minimal height profile when the first and second extension frames are in the retracted positions in comparison to the expanded positions.

16. The pallet of claim 8, wherein the first and second fork channels are disposed above the transverse fork opening.

17. The pallet of claim 8, wherein the first and second fork channels define a portion of an upper boundary of the transverse fork opening.

18. The pallet of claim 8, further comprising a ramp disposed at the front end of the base.

19. The pallet of claim 8, further comprising a set of deployable wheels rotatably coupled to the base.

20. A stackable pallet comprising:

(a) a base;

(b) first and second fork channels extending from a front end to a rear end of the base, wherein the first fork channel is disposed on a first side of the base and the second fork channel is disposed on a second side of the base, wherein each of the first and second fork channels are sized and structured to receive a fork of a pallet-lifting apparatus;

(c) a transverse fork opening extending from the first side to the second side of the base, wherein the transverse fork opening is sized and structured to receive two forks of the pallet-lifting apparatus;

(d) first and second front base legs and first and second rear base legs coupled to the base;

(e) a first extension frame pivotally coupled to the first and second front base legs, wherein the first extension frame is moveable between a retracted position and an expanded position;

(f) a second extension frame pivotally coupled to the first and second rear base legs, wherein the second extension frame is moveable between a retracted position and an expanded position;

(g) a loading space defined between the first and second fork channels, wherein the loading space is constructed and arranged to receive a wheeled object when the first and second extension frames are in the expanded positions; and (h) a permanent angled lip extending from the front end of the base, wherein the loading space is accessible for the wheeled object via the angled lip.

* * * * *